US009188111B2

(12) United States Patent
Hansen et al.

(10) Patent No.: US 9,188,111 B2
(45) Date of Patent: Nov. 17, 2015

(54) DISPLACEMENT ASSEMBLY FOR A FLUID DEVICE

(75) Inventors: Lowell Dean Hansen, Brandon, MS (US); John Lawrence Walker, Madison, MS (US)

(73) Assignee: Eaton Corporation, Cleveland, OH (US)

( * ) Notice: Subject to any disclaimer, the term of this patent is extended or adjusted under 35 U.S.C. 154(b) by 1151 days.

(21) Appl. No.: 13/145,393

(22) PCT Filed: Dec. 14, 2009

(86) PCT No.: PCT/US2009/067885

§ 371 (c)(1),
(2), (4) Date: Oct. 3, 2011

(87) PCT Pub. No.: WO2010/085301

PCT Pub. Date: Jul. 29, 2010

(65) Prior Publication Data

US 2012/0042774 A1 Feb. 23, 2012

Related U.S. Application Data

(60) Provisional application No. 61/145,879, filed on Jan. 20, 2009.

(51) Int. Cl.
*F04B 1/107* (2006.01)
*F01B 1/06* (2006.01)
(Continued)

(52) U.S. Cl.
CPC ..... *F04B 1/1071* (2013.01); *F01B 1/0689* (2013.01); *F01B 13/068* (2013.01); *F04B 1/07* (2013.01); *F04B 49/125* (2013.01)

(58) Field of Classification Search
CPC ..... F04B 1/1071; F04B 1/07; F04B 1/1072; F04B 1/0439; F04B 49/125; F04B 49/126; F04B 49/128; F01B 13/062; F01B 13/061; F01B 13/066; F01B 1/0689; F01B 1/0668; F01B 1/0658; F04C 14/223; F04C 14/20
See application file for complete search history.

(56) References Cited

U.S. PATENT DOCUMENTS 1,924,017 A * 8/1933 Bedford ..... 60/491
2,074,068 A * 3/1937 Ferris ..... 91/496
(Continued)

FOREIGN PATENT DOCUMENTS

CN 1089686 A 7/1994
DE 2 047 055 A1 3/1972
(Continued)

OTHER PUBLICATIONS

DE2460512A1—machine translation to English of description by espacenet.com. Jun. 1976.*
(Continued)

*Primary Examiner* — Edward Look
*Assistant Examiner* — Michael Quandt
(74) *Attorney, Agent, or Firm* — Merchant & Gould P.C.

(57) ABSTRACT

A displacement assembly includes a rotor and a plurality of reciprocating members in engagement with the rotor. The displacement assembly further includes a ring assembly. The ring assembly defines a cam surface that is in engagement with the reciprocating members. The ring assembly has a first ring and an axially adjacent second ring with at least one of the first and second rings being adapted for selective movement relative to the other between a neutral position and a displaced position. The first ring has a first ring portion defining a bore that has an inner surface. The second ring has a second ring portion defining a bore that has an inner surface. A first circumferential portion of the inner surface of the first ring portion and a second circumferential portion of the inner surface of the second ring portion define the cam surface in the displaced position.

29 Claims, 20 Drawing Sheets

(51) Int. Cl.

| | |
|---|---|
| ***F01B 13/06*** | (2006.01) |
| ***F04B 1/07*** | (2006.01) |
| ***F04B 49/12*** | (2006.01) |

(56) References Cited

U.S. PATENT DOCUMENTS

| | | | | |
|---|---|---|---|---|
| 2,217,796 | A | 10/1940 | Dell | |
| 2,662,484 | A * | 12/1953 | Eller | 91/485 |
| 4,660,522 | A * | 4/1987 | Babitzka | 123/450 |
| 5,079,994 | A | 1/1992 | Berbuer | |
| 2006/0222512 | A1 * | 10/2006 | Hansen | 417/219 |
| 2011/0268596 | A1 | 11/2011 | Hansen et al. | |

FOREIGN PATENT DOCUMENTS

| | | | |
|---|---|---|---|
| DE | 2460512 | A1 * | 6/1976 |
| DE | 196 52 157 | C1 | 4/1998 |
| DE | 10 2004 049 864 | A1 | 4/2006 |
| EP | 1 686 263 | A1 | 8/2006 |
| FR | 2 876 410 | A1 | 4/2006 |
| GB | 973036 | A | 10/1964 |

OTHER PUBLICATIONS

International Search Report for corresponding International Patent Application Serial No. PCT/US2009/067885 mailed Feb. 18, 2010.

* cited by examiner

DISPLACEMENT ASSEMBLY FOR A FLUID DEVICE

CROSS-REFERENCE TO RELATED APPLICATIONS

This application is a National Stage Application of PCT/US2009/067885, filed Dec. 14, 2009, which claims benefit of U.S. Provisional Patent Application Ser. No. 61/145,879 entitled "Variable Displacement Fluid Device" and filed on Jan. 20, 2009 and which applications are incorporated herein by reference. To the extent appropriate, a claim of priority is made to each of the above disclosed applications.

BACKGROUND

Fluid devices, such as fluid pumps, typically include a variable displacement assembly (e.g., a rotor assembly, cylinder barrel assembly, gerotor assembly, etc.) that displaces a certain volume of fluid as the variable displacement assembly rotates about a rotational axis. Of these fluid devices, many are of the types that include rotors with fluid pumping elements that reciprocate radially relative to a rotational axis (e.g., vane type, radial piston type, cam-lobe type, etc.). These fluid pumping elements act against a cam surface. As the rotor rotates about the rotational axis, the fluid pumping elements extend and retract in response to the rise and fall of the cam surface. This extension and retraction of the fluid pumping elements results in fluid being pumped through the fluid device.

These types of fluid devices can be fixed displacement devices or variable displacement devices. In the variable displacement devices, the displacement is typically varied by offsetting the rotor relative to the cam surface. Such an offset can increase or decrease the distance traveled by the fluid pumping elements thereby increasing or decreasing the volume of fluid displaced through the fluid device.

SUMMARY

An aspect of the present disclosure relates to a variable displacement assembly for a fluid device. The variable displacement assembly includes a rotor and a plurality of reciprocating members in engagement with the rotor. The variable displacement assembly further includes a ring assembly. The ring assembly defines a cam surface that is in engagement with the reciprocating members. The ring assembly has a first ring and an axially adjacent second ring with at least one of the first and second rings being adapted for selective movement relative to the other between a neutral position and a displaced position. The first ring has a first ring portion defining a bore that has an inner surface. The second ring has a second ring portion defining a bore that has an inner surface. A first circumferential portion of the inner surface of the first ring portion and a second circumferential portion of the inner surface of the second ring portion define the cam surface in the displaced position.

Another aspect of the present disclosure relates to a fluid device. The fluid device includes a housing defining a fluid inlet and a fluid outlet. A displacement assembly is in fluid communication with the fluid inlet and the fluid outlet. The displacement assembly includes a rotor, a plurality of reciprocating members, and a ring assembly. The rotor has a rotation axis about which the rotor selectively rotates and defines a plurality of bores. The plurality of reciprocating members is in engagement with the plurality of bores of the rotor. The ring assembly defines a cam surface in engagement with the reciprocating members. The ring assembly includes a first ring and an axially adjacent second ring. At least one of the first and second rings is adapted for selective movement relative to the other between a neutral position and a displaced position. The first ring has a first ring portion and defines a central axis. The second ring has a second ring portion and defines a central axis. At least one of the central axes of the first and second ring portions is offset from the rotational axis of the rotor in the displaced position. In one embodiment, the displacement assembly is variable.

Another aspect of the present disclosure relates to a variable displacement assembly for a rotary fluid device. The variable displacement assembly includes a rotor, a plurality of reciprocating members, and a ring assembly. The rotor has a rotation axis about which the rotor selectively rotates and defines a plurality of bores. The plurality of reciprocating members is in engagement with the plurality of bores of the rotor. The ring assembly defines a cam surface in engagement with the reciprocating members. The ring assembly includes a first ring and an axially adjacent second ring. At least one of the first and second rings is adapted for selective movement relative to the other between a neutral position and a displaced position. The first ring has a first ring portion having at least one displacement ring. The at least one displacement ring defines a central axis. The second ring has a second ring portion having at least two displacement rings. The at least two displacement rings define a central axis. At least one of the central axes of the first and second ring portions is offset from the rotational axis of the rotor in the displaced position.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Figure 1:
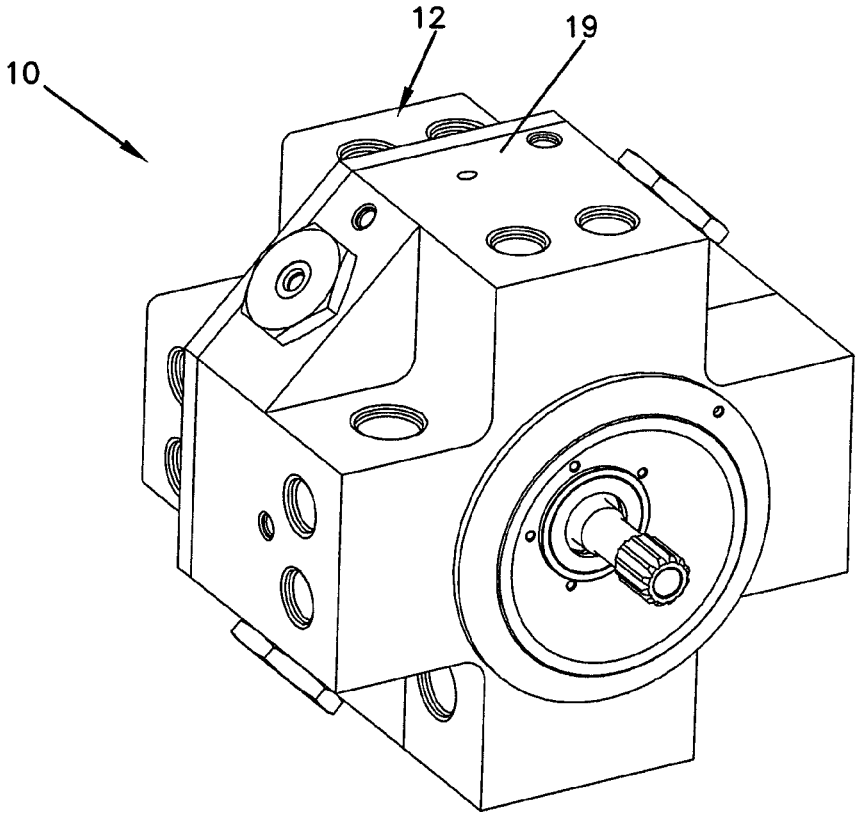
FIG. 1 is a perspective view of a fluid device having exemplary features of aspects in accordance with the principles of the present disclosure.

Referring now to FIG. 1, a fluid device, generally designated 10, is shown. In the depicted embodiment of FIG. 1, the fluid device 10 is a radial piston type fluid device. It will be understood, however, that the scope of the present disclosure is not limited to the fluid device 10 being a radial piston type fluid device. While the fluid device 10 will be described as a pump, it will be understood that the scope of the present disclosure is not limited to the fluid device 10 functioning as a pump as the fluid device 10 could alternatively function as a motor.

In addition, the fluid device 10 will be described as a double pump device. The double pump device includes two sets of fluid pumping components. The two sets of fluid pumping components are potentially advantageous as it allows the fluid device 10 to serve two separate fluid circuits or to supply a single fluid circuit with a greater volume of fluid. While the fluid device 10 will be described as a double pump device, it will be understood that the scope of the present disclosure is not limited to the fluid device 10 being a double pump design.

Figure 2:
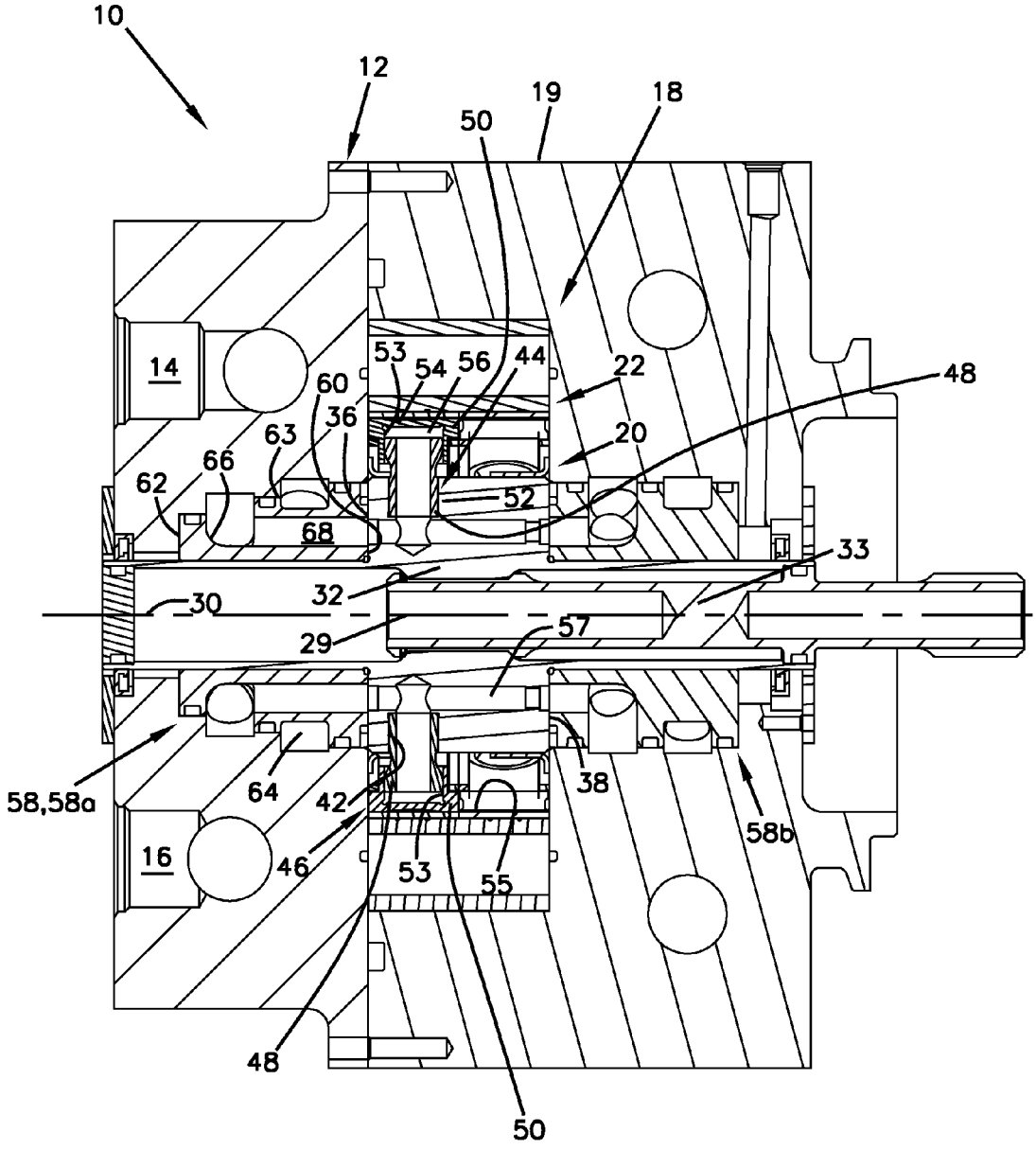
FIG. 2 is a cross-sectional view of the fluid device of FIG. 1.

Referring now to FIGS. 1 and 2, the fluid device 10 includes a housing, generally designated 12, defining a fluid inlet 14 and a fluid outlet 16. The fluid device 10 further includes a variable displacement assembly, generally designated 18, that is in fluid communication with the fluid inlet 14 and the fluid outlet 16.

In the depicted embodiment of FIG. 2, the variable displacement assembly 18 is disposed adjacent to the housing 12. In another embodiment, the variable displacement assembly 18 is disposed within an outer ring 19 that is tightly engaged with the housing 12. The variable displacement assembly 18 includes a rotor assembly, generally designated 20, and a ring assembly, generally designated 22.

Figure 3:
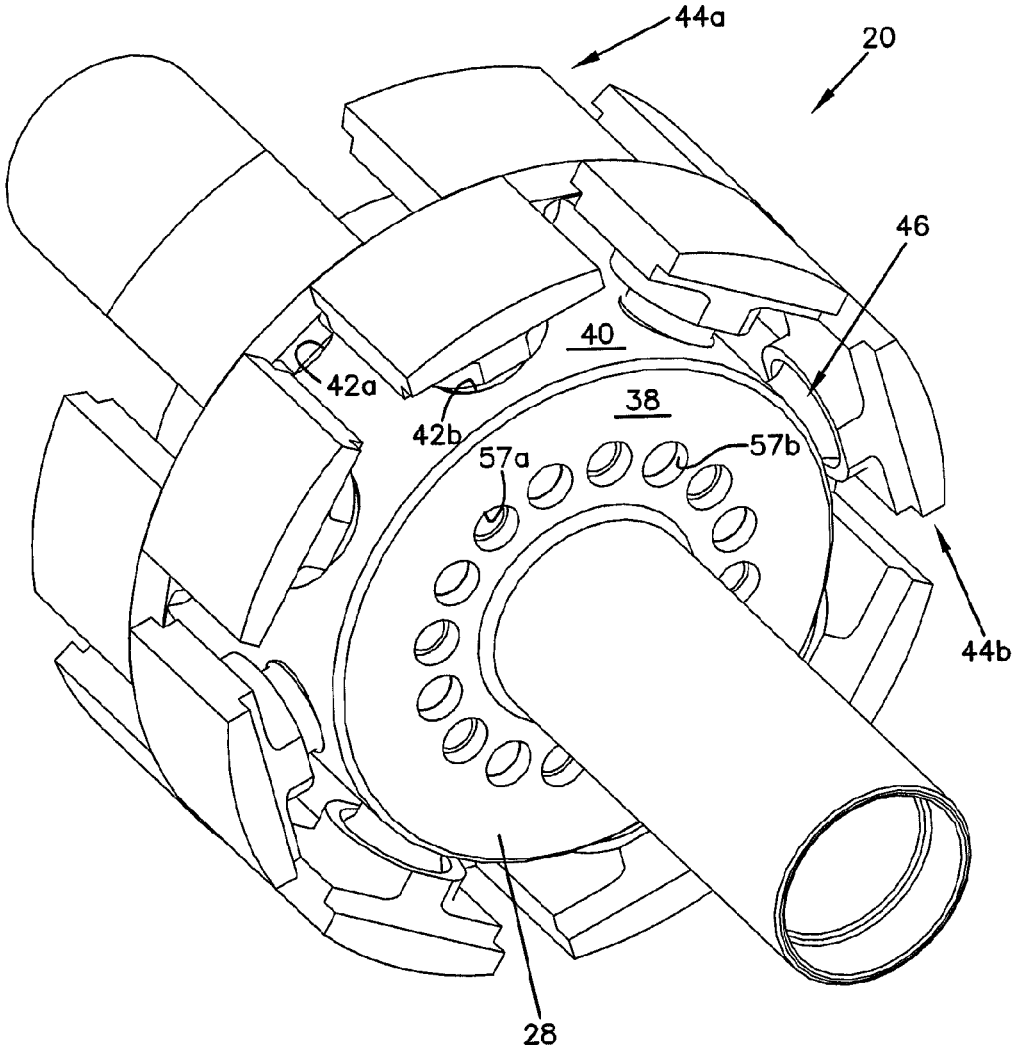
FIG. 3 is a perspective view of a rotor assembly suitable for use with the fluid device of FIG. 1.

Referring now to FIGS. 2 and 3, the rotor assembly 20 includes a rotor, generally designated 28, defining a rotation axis 29 about which the rotor 28 is adapted to rotate. In the subject embodiment, the rotation axis 29 of the rotor 28 is generally aligned with a longitudinal central axis 30 of the fluid device 10.

In the subject embodiment, the rotor 28 includes an internal spline 32 that is adapted for engagement with a main drive 33. When the fluid device 10 is used as a pump, the rotor assembly 20 rotates about the rotation axis 29 in response to rotation of the main drive 33. As the rotor assembly 20 rotates, fluid is transferred or pumped from one location (e.g., a reservoir, etc.) to another location (e.g., an actuator, etc.).

The rotor 28 includes a body 34 having a first face 36, which is generally perpendicular to the rotation axis 29, an oppositely disposed second face 38, which is generally parallel to the first face 36, and an outer surface 40 disposed between the first and second faces 36, 38. In the subject embodiment, the rotor 28 is cylindrical in shape. Therefore, in the subject embodiment, the outer surface 40 is an outer circumferential surface.

The outer surface 40 defines a plurality of bores 42 disposed about the rotor 28. The bores 42 radially extend from the outer surface 40 toward the rotation axis 29 of the rotor 28. In the subject embodiment, the outer surface 40 defines a first plurality of bores 42*a* and a second plurality of bores 42*b*. As best shown in FIG. 3, the first plurality of bores 42*a* is axially and rotationally offset from the second plurality of bores 42*b*. The first plurality of bores 42*a* is adapted to receive a first plurality of radially reciprocating members 44*a* while the second plurality of bores 42*b* is adapted to receive a second plurality of radially reciprocating members 44*b*.

In the subject embodiment, the first and second plurality of bores 42*a*, 42*b* are substantially similar. In addition, the first and second plurality of radially reciprocating members 44*a*, 44*b* are substantially similar. Therefore, for ease of description purposes, the first and second plurality of bores 42*a*, 42*b* will be referred to as bores 42 while the first and second plurality of radially reciprocating members 44*a*, 44*b* will be referred to as reciprocating members 44.

In the subject embodiment, the reciprocating members 44 are radial pistons 46 suitable for use in a radial piston type fluid device. The radial pistons 46 include piston members 48 and piston shoes 50. In one embodiment, the piston members 48 are adapted for stationary engagement in the bores 42 while the piston shoes 50 are adapted to reciprocate relative to the piston members 48. The piston members 48 include first axial end portions 52 and second axial end portions 54. The first axial end portions 52 are adapted for insertion in the bores 42. The second axial end portions 54 are adapted for insertion in a cavity 53 of the piston shoes 50.

The piston shoes 50 of the reciprocating members 44 are adapted for engagement with a cam surface 55 of the ring assembly 22. As the rotor assembly 20 rotates about the rotation axis 29, the piston shoes 50 of the reciprocating members 44 reciprocate relative to the piston members 48 in response to engagement with the cam surface 55 of the ring assembly 22. As the piston shoes 50 reciprocate relative to the piston members 48, volume chambers 56, which are cooperatively defined by the cavities 53 of the piston shoes 50 and the second axial end portions 54 of the piston members 48, expand and contract.

The variable displacement assembly 18 includes at least one inlet region at which fluid is drawn into the variable displacement assembly 18 and at least one outlet region at which fluid is expelled from the variable displacement assembly 18. In the inlet region of the variable displacement assembly 18, a distance between the cam surface 55 of the ring assembly 22 and the rotor 28 increases as the rotor assembly 20 rotates. As the distance between the cam surface 55 and the rotor 28 increases, the piston shoes 50 extend outwardly from the second axial end portions 54 of the piston members 48 causing the corresponding volume chambers 56 to expand and draw fluid in from the fluid inlet 14.

In the outlet region of the variable displacement assembly 18, the distance between the cam surface 55 and the rotor 28 decreases as the rotor assembly 20 rotates. As the distance between the cam surface 55 and the rotor 28 decreases, the piston shoes 50 retract on the second axial end portions 54 of the piston members 44 causing the corresponding volume chambers 56 to contract and expel fluid out the fluid outlet 16. In the subject embodiment, the variable displacement assembly 18 includes two inlet regions and two outlet regions.

In one embodiment, one of the first and second faces 36, 38 of the rotor 28 includes a plurality of fluid passages 57. The fluid passages 57 of the rotor 28 are in fluid communication with the volume chambers 56 in the rotor assembly 20. In the subject embodiment, the first and second faces 36, 38 define a first plurality of fluid passages 57*a* that are in fluid communication with the first plurality of bores 42*a* and a second plurality of fluid passages 57*b* that are in fluid communication with the second plurality of bores 42*b*.

In one embodiment, the rotor 28 is in commutating fluid communication with a pintle 58. In the subject embodiment, the rotor 28 is in commutating fluid communication with a first pintle 58*a* and a second pintle 58*b*. The first and second pintles 58*a*, 58*b* are non-rotatably disposed in the housing 12 and are in fluid communication with the fluid inlet 14 and the fluid outlet 16 of the fluid device 10. In the subject embodiment, each of the first and second pintles 58*a*, 58*b* includes a first axial end 60, an opposite second axial end 62 and an outer circumferential surface 63.

The outer circumferential surface 63 defines a first groove 64 that is in fluid communication with the fluid inlet 14 and a second groove 66 that is in fluid communication with the fluid outlet 16. The first axial end 60 of the pintle 58 defines a plurality of inlet fluid passageways 68 in fluid communication with the first groove 64 and a plurality of outlet fluid passageways in fluid communication with the second groove 66.

The first axial end 60 of the first pintle 58*a* is adapted for sealing engagement with the first face 36 of the rotor 28 while the first axial end 60 of the second pintle 58*b* is adapted for sealing engagement with the second face 38 of the rotor 28. As the rotor 28 rotates about the rotation axis 29, the inlet fluid passageways 68 and outlet fluid passageways of the first and second pintles 58*a*, 58*b* are in commutating fluid communication with the first and second plurality of fluid passages 57*a*, 57*b*, respectively, of the rotor assembly 20 such that fluid from the inlet fluid passageways 68 of the first and second pintles 58*a*, 58*b* are drawn into the expanding volume chambers 56 while fluid from the contracting volume chambers 56 is expelled through the outlet fluid passageways.

Figure 4:
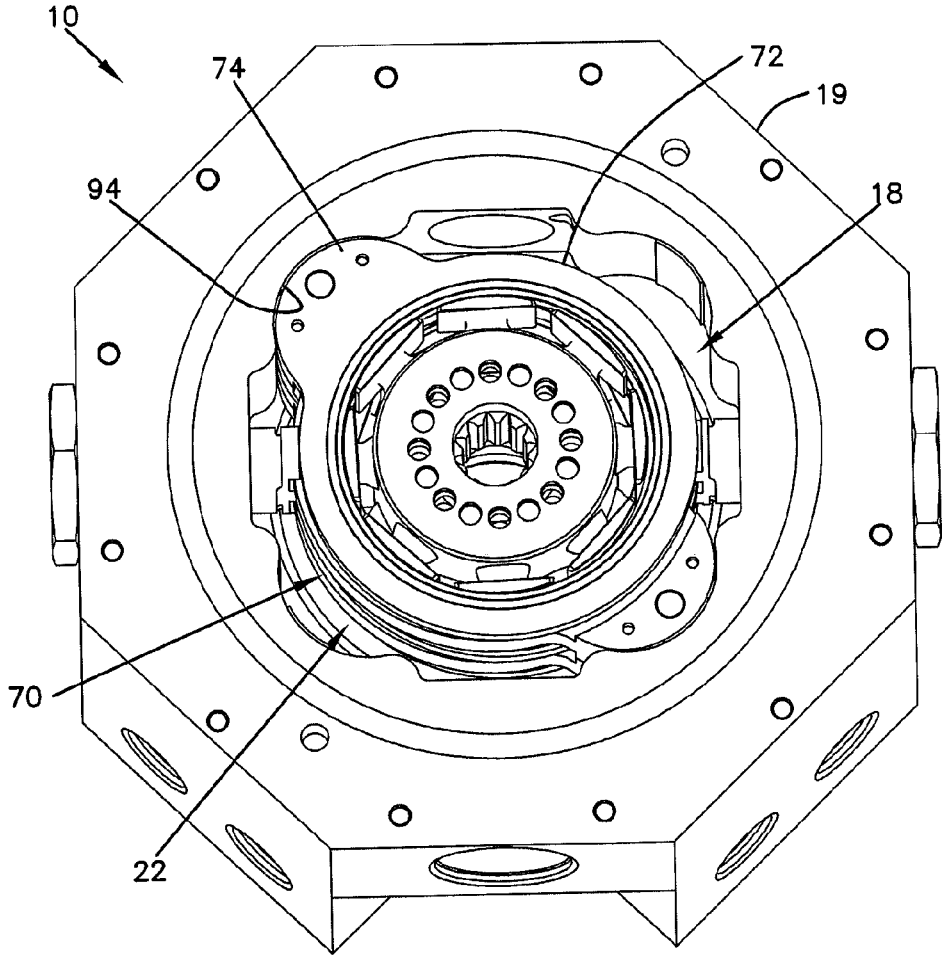
FIG. 4 is a perspective view of a variable displacement assembly suitable for use with the fluid device of FIG. 1.
Figure 5:
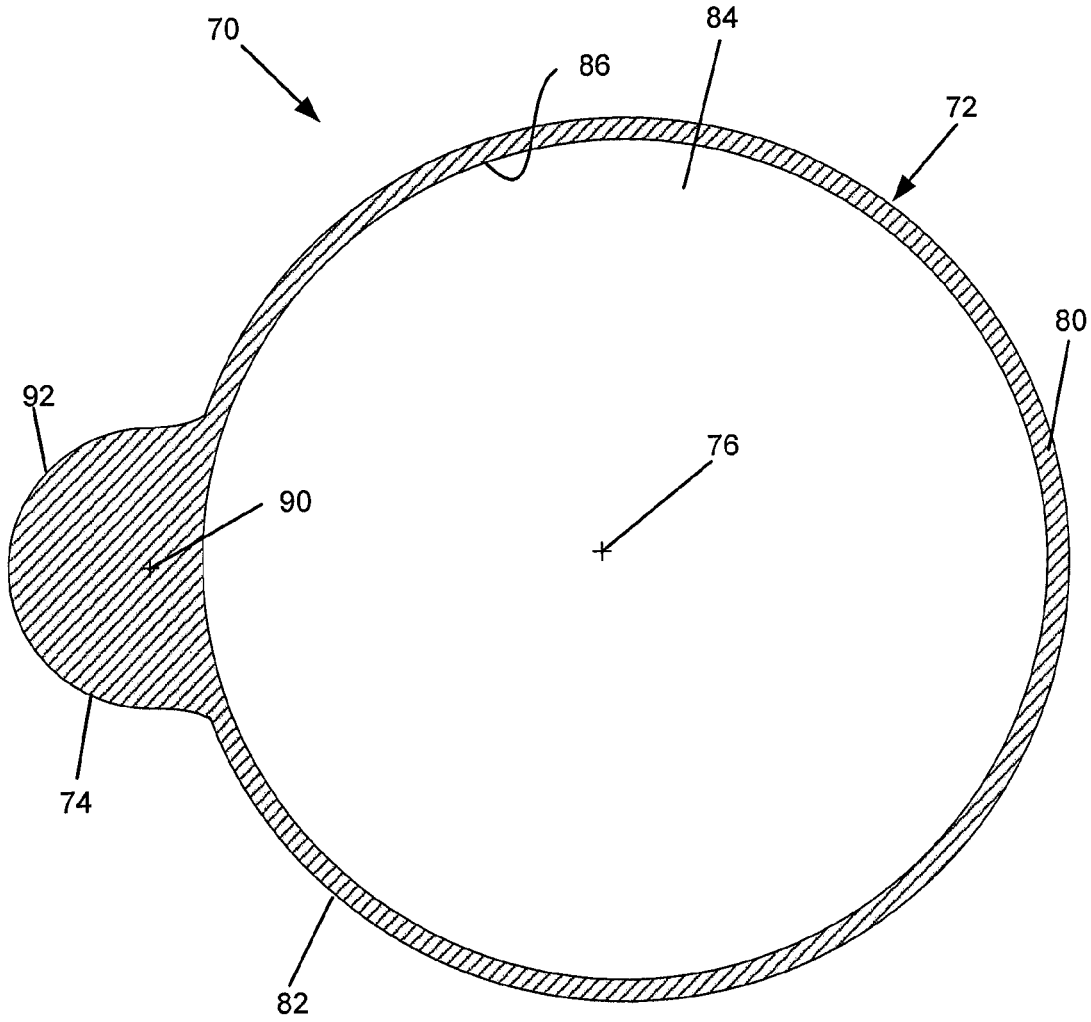
FIG. 5 is a front view of a ring suitable for use in the variable displacement assembly of FIG. 4.

Referring now to FIGS. 4 and 5, the ring assembly 22 of the variable displacement assembly 18 is shown. The ring assembly 22 includes at least two rings 70 that are adjacently disposed. Each of the rings 70 includes a ring portion 72. In the depicted embodiment of FIGS. 4 and 5, the ring assembly 22 further includes a pivot portion 74 about which the rings 70 selectively pivot.

The ring portion 72 of each of the rings 70 is generally cylindrical and defines a central axis 76. The ring portion 72 includes a first surface 78 (best shown in FIG. 7) and an oppositely disposed second surface 80. In the subject embodiment, the first and second surfaces 78, 80 are generally parallel. When the rings 70 are disposed in the fluid device 10, the first and second surfaces 78 and 80 are generally perpendicular to the longitudinal central axis 30 of the fluid device 10. The ring portion 72 further includes an outer surface 82 that extends between the first and second surfaces 78, 80.

The ring portion 72 defines a bore 84 that extends through the first and second surfaces 78, 80. In the subject embodiment, the bore 84 is generally cylindrical and is axisymmetric about the central axis 76 of the ring portion 72. The bore 84 includes an inner surface 86 having a radius. In the subject embodiment, at least a portion of the rotor assembly 20 is disposed within the bore 84 such that at least a portion of the reciprocating members 44 act against at least a portion of the inner surface 86. In one embodiment, at least a portion of the reciprocating members 44 act directly against at least a portion of the inner surface 86 of the bore 84.

The pivot portion 74 of each of the plurality of rings 70 extends outwardly from the outer surface 82 of the ring portion 72. The pivot portion 74 is adapted to provide pivoting or rocking movement of the ring 70. In the subject embodiment, each of the pivot portions 74 includes a pivot axis 90 about which the ring 70 pivots.

In the subject embodiment, the pivot portion 74 includes a convex surface 92. The convex surface 92 is adapted for engagement in a pocket 94 of a support structure such as the outer ring 19 or the housing 12. The pocket 94 prevents the pivot portion 74 from moving in a radial outward direction from the longitudinal central axis 30 of the fluid device 10 while allowing the pivot portion 74 to pivot within the pocket 94.

Figure 6:
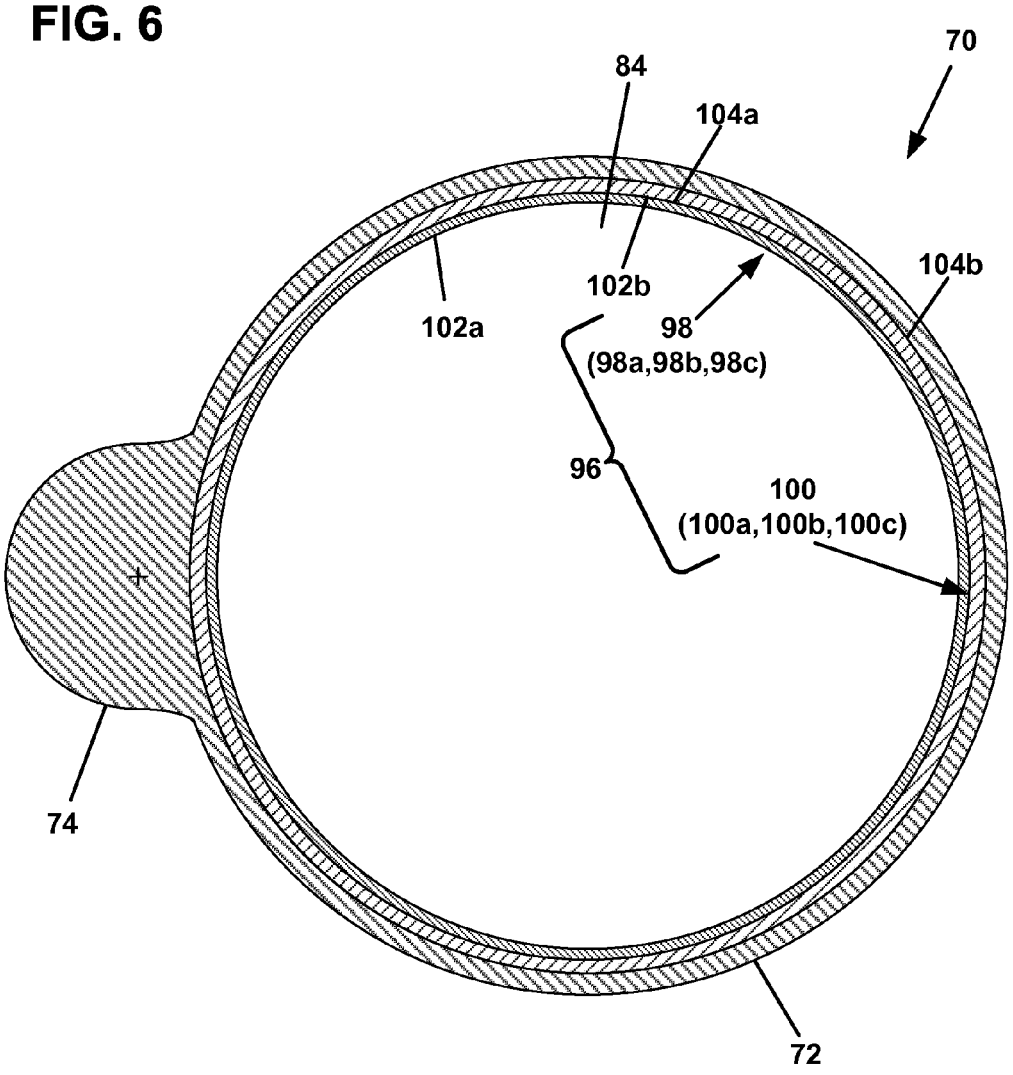
FIG. 6 is a front view of the ring of FIG. 5 in engagement with a band assembly.
Figure 7:
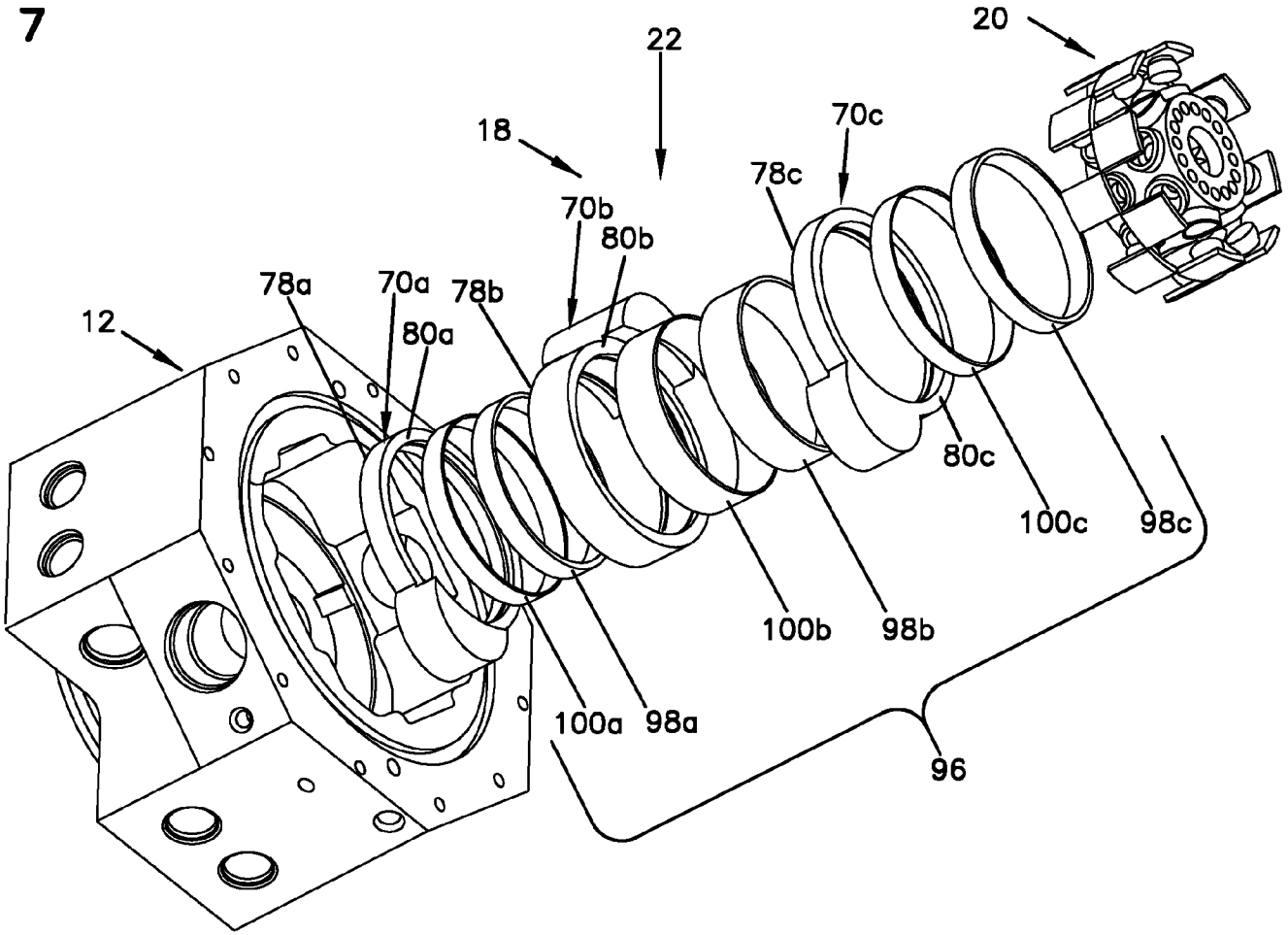
FIG. 7 is an exploded perspective view of the variable displacement assembly of FIG. 5.

Referring now to FIG. 6, the ring 70 of the ring assembly 22 is shown. In the subject embodiment, the ring 70 includes a band assembly 96. The band assembly 96 is disposed in the bore 84 of the ring 70 (including 70*a*, 70*b*, 70*c* as illustrated in FIG. 7). In the subject embodiment, the band assembly 96 includes an inner band 98 /including 98*a*, 98*b*, 98*c* as illustrated in FIG. 7) and an outer band 100 (including 100*a*, 100*b*, 100*c* as illustrated in FIG. 7). The inner and outer bands 98, 100 each include an inner surface 102*a*, 102*b*, respectively, and an outer surface 104*a*, 104*b*. The outer surface 104*a* of the inner band 98 is adapted for sliding engagement with the inner surface 102*b* of the outer band 100.

In the subject embodiment, the inner surface 102*a* of the inner band 98 is adapted for direct engagement with the reciprocating members 44. The frictional forces between the inner surface 102*a* of the inner band 98 and the reciprocating members 44 cause the inner band 98 to rotate about the rotation axis 29. In the subject embodiment, the inner band 98 rotates about the rotation axis 29 of the rotor assembly 20 at substantially the same speed as the rotor assembly 20. While the inner band 98 rotates about the rotation axis 29, the outer band 100 remains rotationally stationary in the ring 70.

The inner band 98 is made from a first material having a first thickness while the outer band 100 is made from a second material having a second thickness. In the subject embodiment, the first material is different than the second material. The first and second materials are selected so as to provide a suitable bearing surface at the interface between the inner and outer bands 98, 100. In the subject embodiment, and by way of example only, the first material is a nickel bronze material while the second material is a bearing quality tool steel (e.g., 52100, etc.).

Referring now to FIG. 7, an exploded view of the variable displacement assembly 18 is shown. In the subject embodiment, the rings 70 of the ring assembly 22 include a first ring 70*a*, a second ring 70*b* and a third ring 70*c*. The second ring 70*b* is disposed between the first ring 70*a* and the third ring 70*c* such that the first surface 78 of the second ring 70*b* is disposed adjacent to the second surface 80 of the first ring 70*a* while the second surface 80 of the second ring 70*b* is disposed adjacent to the first surface 78 of the third ring 70*c*. In the subject embodiment, each of the first, second and third rings 70*a*, 70*b*, 70*c* include the band assembly 96.

Referring now to FIGS. 8-11, schematic representations of the variable displacement assembly 18 are shown. For ease of illustration and description purposes, the variable displacement assembly 18 will be described as having only a single set of pumping components. Therefore, the ring assembly 22 will be shown as having only the first and second rings 70*a*, 70*b* and a single set of reciprocating members 44. It will be understood, however, that the scope of the present disclosure is not limited to the variable displacement assembly 18 having a single set of pumping components. In addition, for ease of illustration purposes, the band assemblies 96 associated with each of the first and second rings 70*a*, 70*b* have been removed from FIGS. 8-11.

Figure 8:
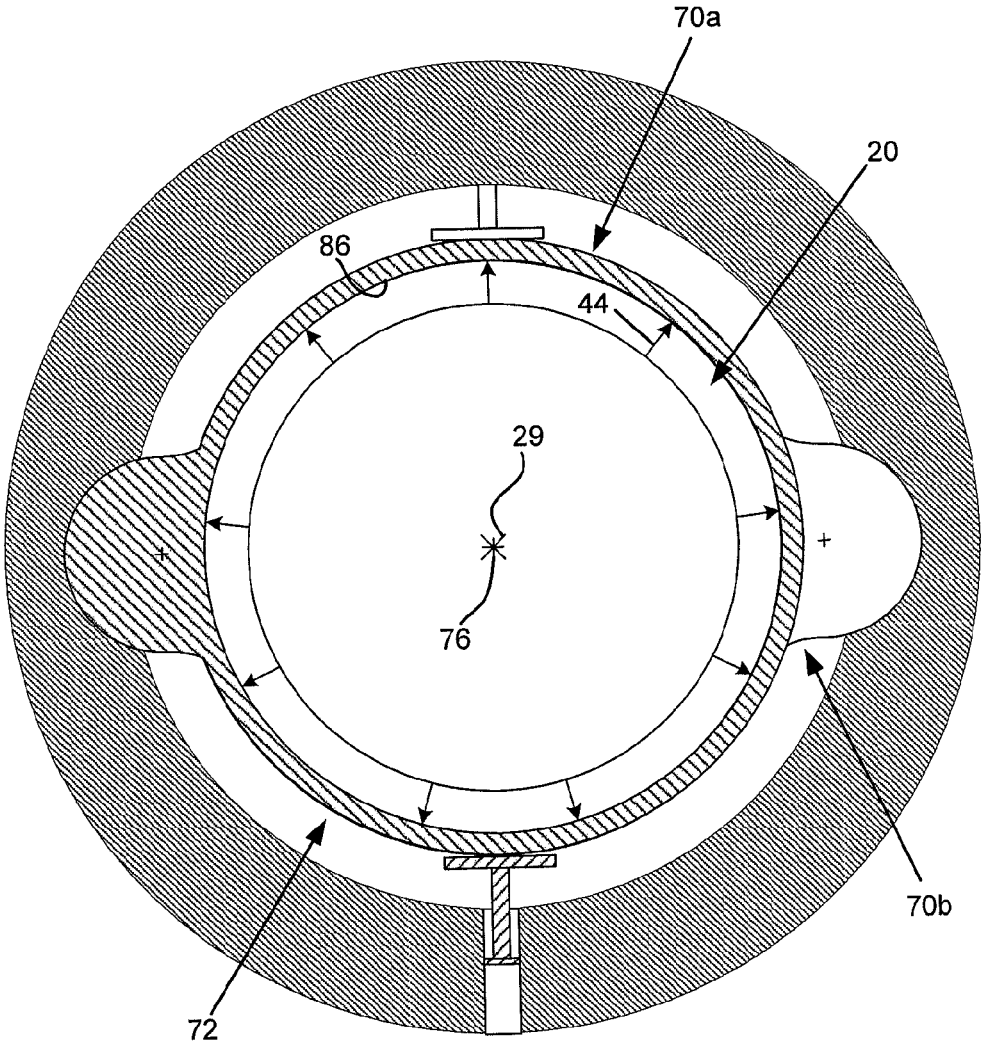
FIG. 8 is a schematic representation of the variable displacement assembly in a neutral position.

In FIG. 8, the variable displacement assembly 18 is shown in a neutral or central position. In the neutral position, each central axis 76 of the first and second rings 70*a*, 70*b* is generally coaxial with the rotation axis 29 of the rotor assembly 20.

As the inner surface 86 of the ring portion 72 of each of the first and second rings 70*a*, 70*b* is generally circular in shape, the reciprocating members 44 (shown schematically as arrows in FIG. 8) of the rotor assembly 20 generally do not reciprocate while the first and second rings 70*a*, 70*b* are in the neutral position. As the reciprocating members 44 do not reciprocate in the neutral position, the volume chambers 56 do not expand or contract. As a result, the displacement of the fluid device 10 when the fluid device 10 is in the neutral position is about zero cubic inches per revolution. As used in the present disclosure, the term "displacement" will be understood to be a fluid power variable that indicates the volume of fluid that passes through the fluid device 10 with each rotation of the rotor assembly 20.

Figure 9:
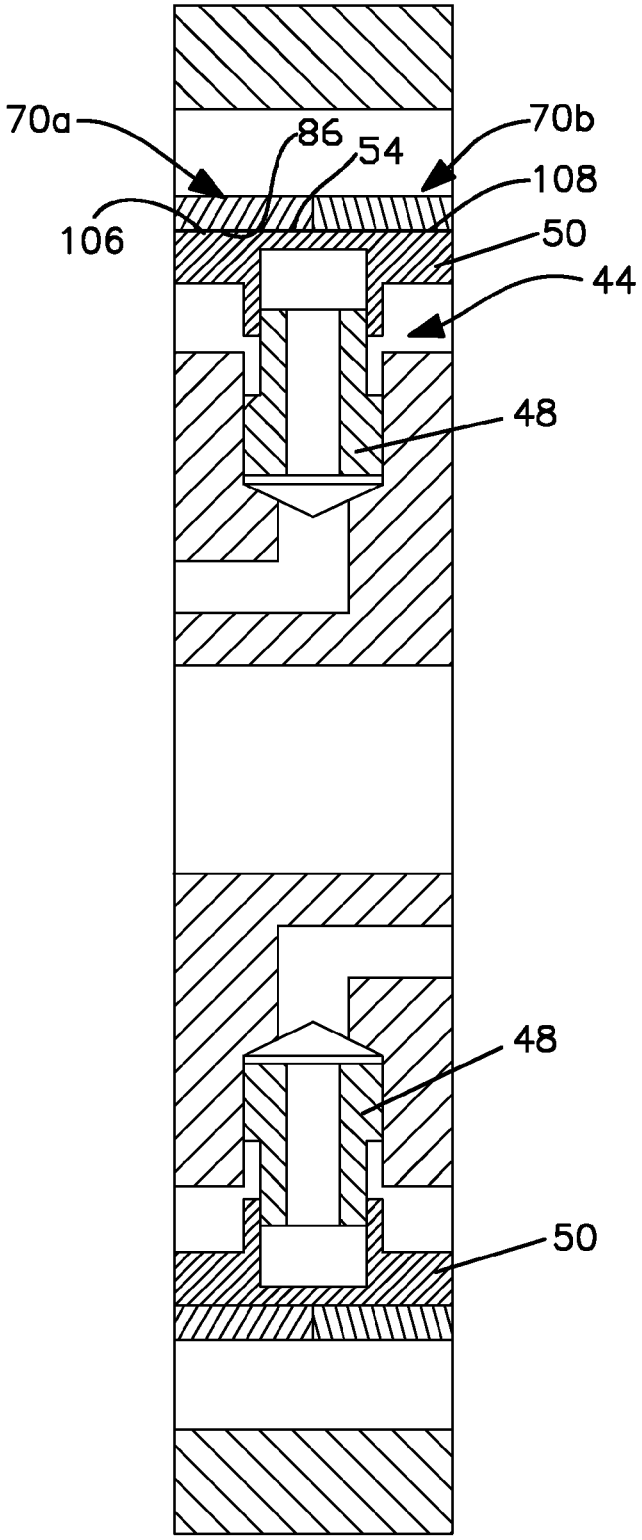
FIG. 9 is a schematic cross-sectional view of the variable displacement assembly of FIG. 8.

As best shown in FIG. 9, in the neutral position, a first portion 106 of each of the second axial ends 54 of the reciprocating members 44 acts against the inner surface 86 of the first ring 70*a* while a second portion 108 of each of the second axial ends 54 acts against the inner surface 86 of the second ring 70*b*. In one embodiment, the first portion 106 of the second axial ends 54 of the reciprocating members 44 is about equal to the second portion 108. In the subject embodiment, and by way of example only, the first portion 106 is about half of the second axial end 54.

Figure 10:
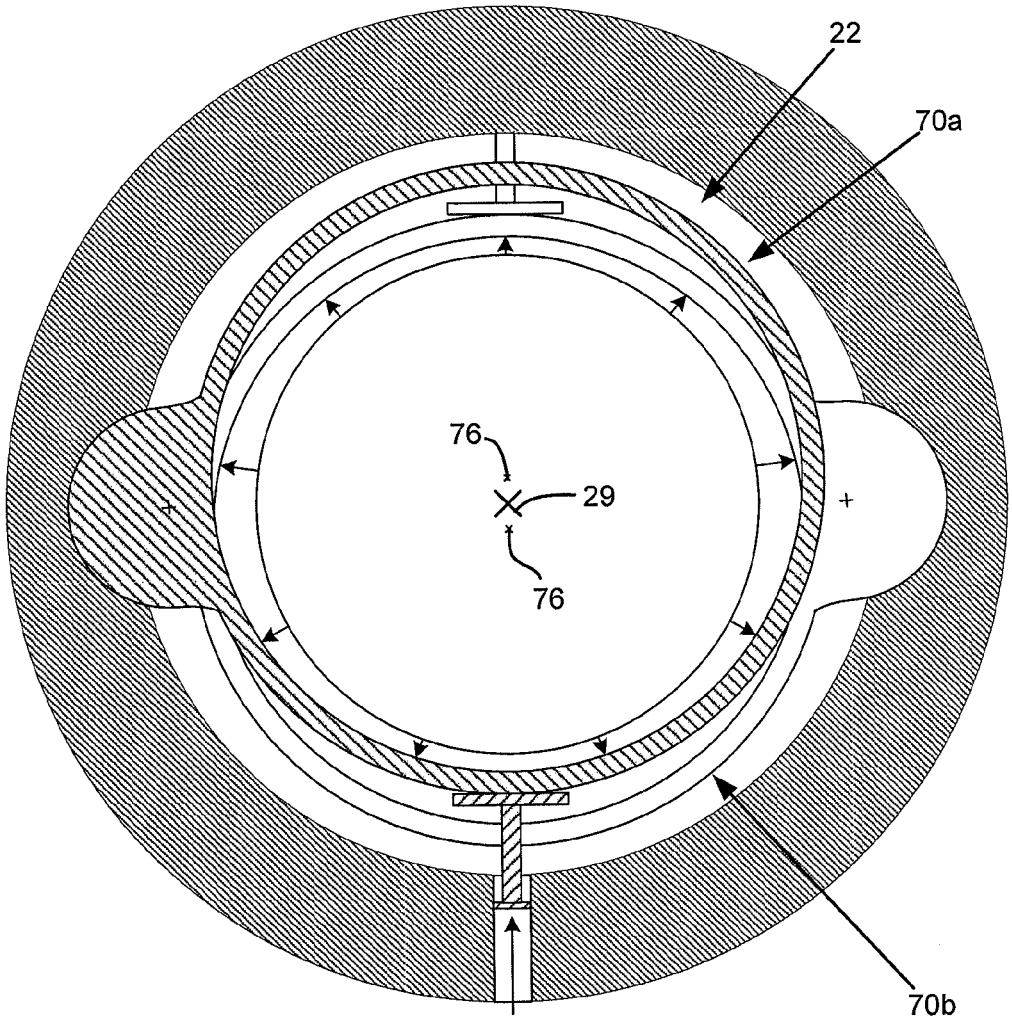
FIG. 10 is a schematic representation of the variable displacement assembly in a displace position.
Figure 11:
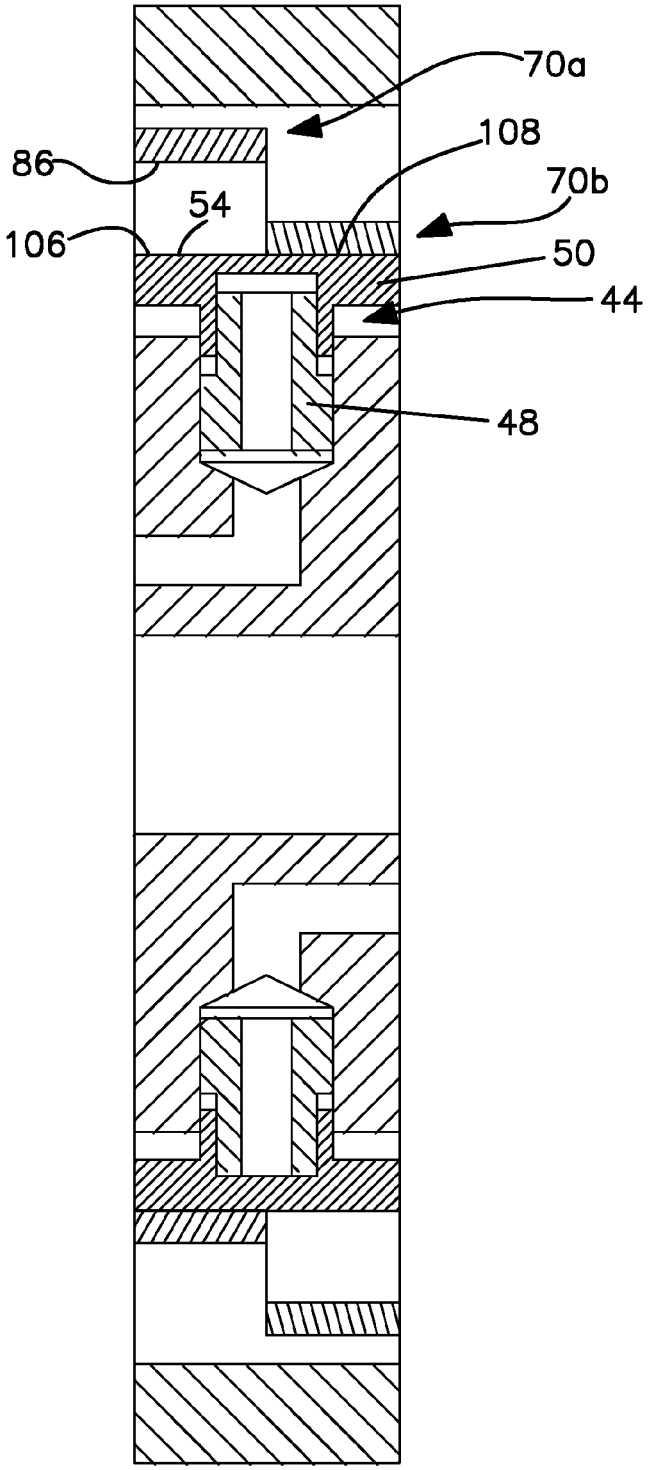
FIG. 11 is a schematic cross-sectional view of the variable displacement assembly of FIG. 10.

At least one of the first and second rings 70*a*, 70*b* is selectively moveable relative to the other between the neutral position (shown in FIGS. 8 and 9) and a displaced position (shown in FIGS. 10 and 11). In the subject embodiment, each of the first and second rings 70*a*, 70*b* is selectively and independently moveable between the neutral position and the displaced position. While the central axes 76 of the rings 70 are coaxial with the rotation axis 29 of the rotor assembly 20 in the neutral position, at least one of the central axes 76 of the rings 70 is offset from the rotation axis 29 of the rotor assembly 20 in the displaced position.

Referring now to FIGS. 10 and 11, the ring assembly 22 is shown in a maximum displaced position. In the subject embodiment, the central axes 76 of the first and second rings 70*a*, 70*b* are offset from the rotational axis 29 of the rotor assembly 20 in the maximum displaced position. In the subject embodiment, the central axis 76 of the first ring 70*a* is offset from the rotation axis 29 in a first direction (e.g., a clockwise direction) while the central axis 76 of the second ring 70*b* is offset from the rotational axis 29 in a second direction (e.g., a counterclockwise direction). In the depicted embodiment of FIGS. 10 and 11, the second direction is in an opposite direction from the first direction.

Figure 12:
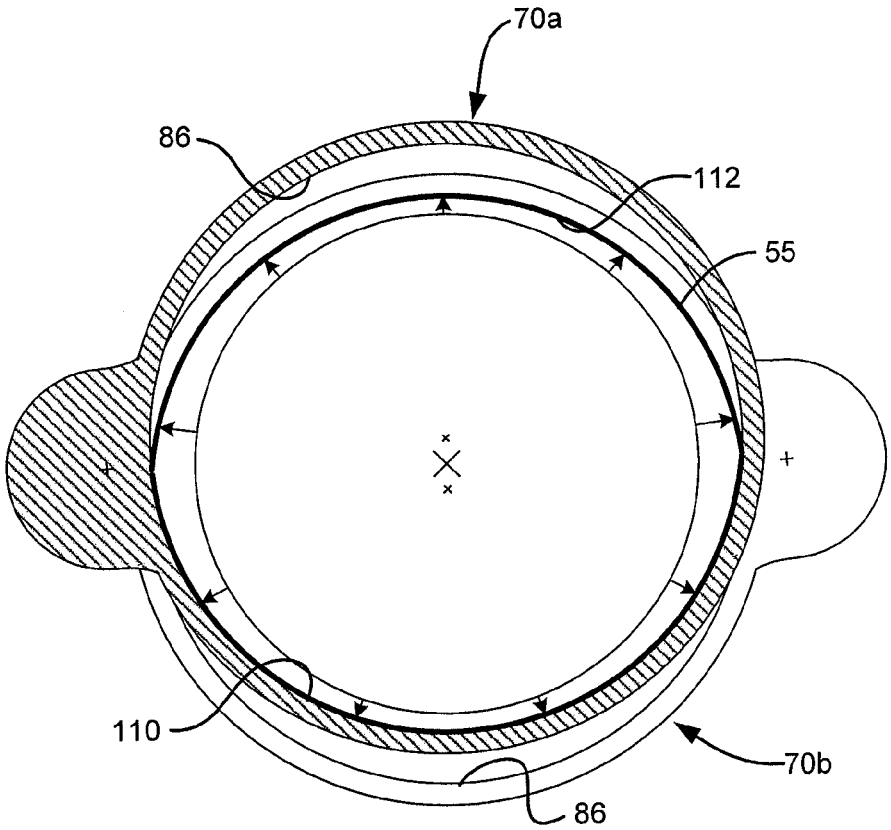
FIG. 12 is a schematic representation of a cam surface of the variable displacement assembly in the displaced position.

Referring now to FIGS. 10-12, with the ring assembly 22 in the displaced position, the cam surface 55 (shown as a bold line in FIG. 12), against which the reciprocating members 44 act, is defined by the intersection or overlap of the first and second rings 70*a*, 70*b* as viewed in the direction of the rotational axis 29. In the displaced position, the cam surface 55 includes a first circumferential portion 110 of the inner surface 86 of the first ring 70*a* and a second circumferential portion 112 of the inner surface 86 of the second ring 70*b*.

In the displaced position, the first circumferential portion 110 of the first ring 70*a* is less than half of the total circumference of the inner surface 86 of the first ring 70*a* or less than 50% of the total circumference of the inner surface 86 of the first ring 70*a*. The second circumferential portion 112 of the second ring 70*b* is also less than half of the total circumference of the inner surface 86 of the second ring 70*b* or less than 50% of the total circumference of the inner surface 86 of the second ring 70*b*. As the percentage of the first and second circumferential portions 110, 112 of the cam surface 55 relative to the total circumference of the inner surfaces 86 of the first and second rings 70*a*, 70*b*, respectively, decrease, the displacement of the variable displacement assembly 18 increases.

Figure 13:
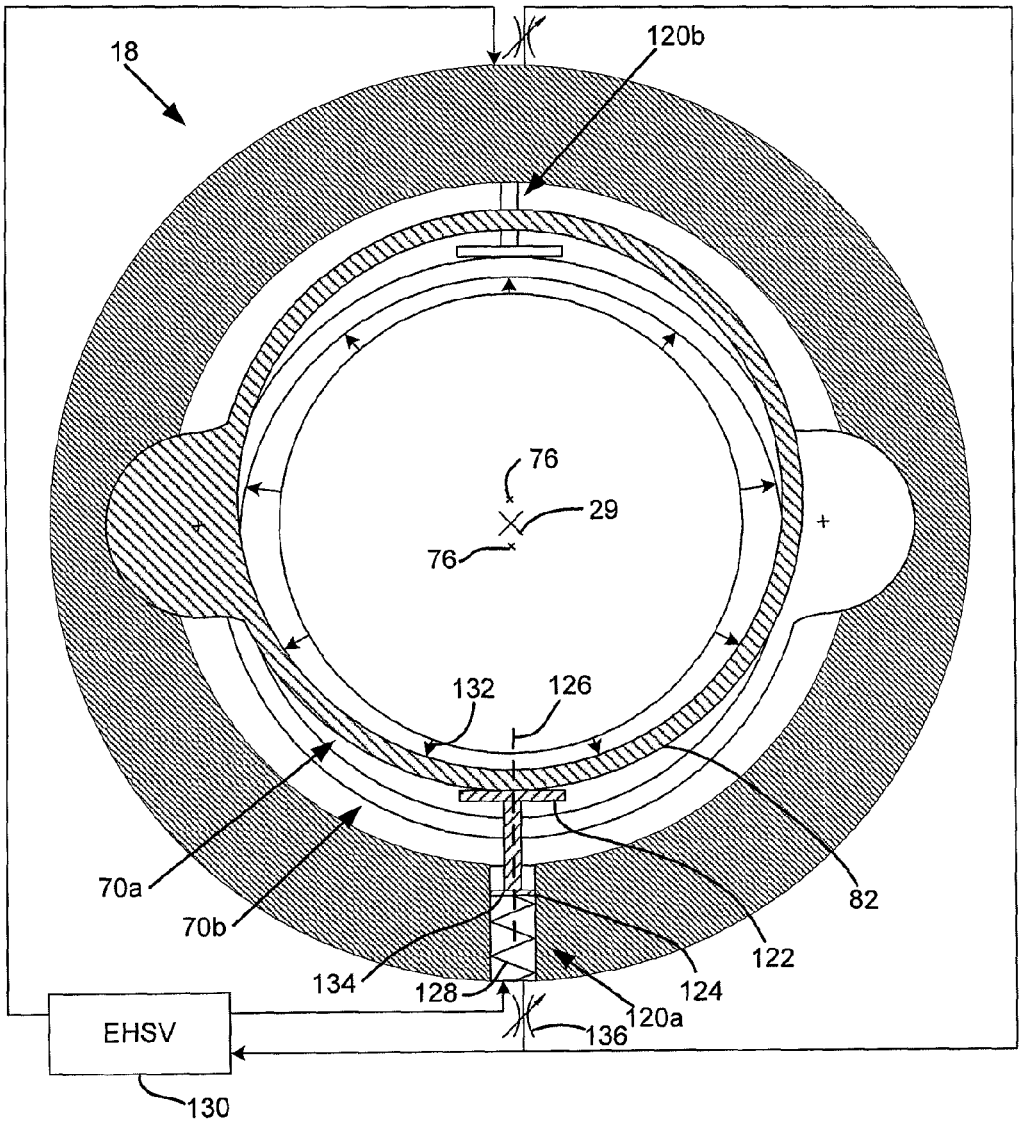
FIG. 13 is a schematic representation of a displacement control scheme suitable for use with the fluid device of FIG. 1.

Referring now to FIGS. 8, 10 and 13, in the subject embodiment, a first displacement piston 120*a* is adapted to position the first ring 70*a* while a second displacement piston 120*b* is adapted to position the second ring 70*b*. The first and second displacement pistons 120*a*, 120*b* are substantially similar. Therefore, for ease of description purposes, the first and/or second displacement pistons 120*a*, 120*b* will be referred to as the displacement piston 120. The displacement piston 120 includes a first end 122 and an opposite second end 124. The first end 122 of the displacement piston 120 is adapted for engagement with the outer surface 82 of one of the ring portions 72 of the first and second rings 70*a*, 70*b*. In the subject embodiment, the first axial end 122 is adapted for direct engagement with the outer surface 82.

The displacement piston 120 extends and retracts along a longitudinal axis 126 that extends radially toward the rotating axis 29 of the rotor assembly 20. In the depicted embodiment, the displacement piston 120 is biased by a spring 128 toward the extended position. In this embodiment, the variable displacement assembly 18 is biased to the maximum displaced position.

Fluid is selectively supplied to the second end 124 of the displacement piston 120 by an electro-hydraulic servo valve 130 (EHSV). In the subject embodiment, the second end 124 of the displacement piston 120 is generally cylindrical in shape. The diameter of the second end 124 of the displacement piston 120 is sized to balance forces 132 (shown schematically as arrows in FIGS. 8 and 10) acting on the inner surface 86 of the ring 70 by the reciprocating members 44. In one embodiment, and by way of example only, the outer diameter of the second end 124 of the displacement piston 120 is larger in size than the outer diameters of the reciprocating members 44.

The pressure of the fluid supplied by the EHSV 130 acts on an end surface 134 of the displacement piston 120 such that the pressure of the fluid acting on the end surface 134 balances the forces 132 acting against the inner surface 86 of the ring 70 by the reciprocating members 44 disposed in the rotor assembly 20. With the forces 132 of the reciprocating members 44 balanced by the pressure from the fluid supplied by the EHSV 130, the full biasing force of the spring 128 is transferred to the ring 70 to offset the ring 70 from the neutral position and thereby increase the displacement of the variable displacement assembly 18.

In the subject embodiment, a variable orifice 136 is in fluid communication with the second end 124 of the displacement piston 120. The variable orifice 136 is selectively operable in a range of positions between fully open and fully closed. With the variable orifice 136 in a position that is at least partially open, the variable orifice 136 relieves a portion of the pressure of the fluid supplied by the EHSV 130 that acts against the end surface 134 of the displacement piston 120. With the pressure of the fluid at least partially relieved, a portion of the biasing force of the spring 128 is used to balance the forces 132 acting against the inner surface 86 of the ring 70. As a result, less spring force is available to displace the variable displacement assembly 18. Therefore, the displacement of the variable displacement assembly 18 is less with the variable orifice 136 in an at least partially open position than in a fully closed position.

Referring now to FIGS. 8-13, the operation of the variable displacement assembly 18 will be described. With the variable displacement assembly 18 in the neutral position, the central axes 76 of the first and second rings 70*a*, 70*b* are in alignment with the rotation axis 29 of the rotor 28. In the neutral position, the ring portions 72 of the first and second rings 70*a*, 70*b* are generally concentric with the rotor 28. With the first and second rings 70*a*, 70*b* in the neutral position, the cam surface 55 is defined by the circumference of the inner surfaces 86 of the first and second rings 70*a*, 70*b*. In the depicted embodiment of FIGS. 8 and 9, the reciprocating members 44 act against the total circumference of at least one of the inner surfaces 86 of the first and second rings 70*a*, 70*b*. As the inner surface 86 is generally circular in shape and as the inner surface 86 is generally concentric with the rotor 28, the displacement of the variable displacement assembly 18 is zero cubic inches per revolution in this position.

With fluid supplied by the EHSV 130 acting on the end surface 134 of at least one of the displacement pistons 120, at least one of the rings 70 pivots about the pivot axis 90 of the pivot portion 74 to the displaced position. As best shown in FIGS. 10 and 11, in the displaced position, the central axis 76 of at least one of the first and second rings 70*a*, 70*b* is offset from the rotational axis 29 of the rotor 28. With the central axis 76 of at least one of the first and second rings 70*a*, 70*b* offset from the rotational axis 29, the cam surface 55 is defined by the first and second circumferential portions 110, 112. During the rotation of the rotor 28, each of the reciprocating members 44 is in contact with at least a portion of the inner surface 86 of the first ring 70*a* (the first circumferential portion 110) and at least a portion of the inner surface 86 of the second ring 70*b* (the second circumferential portion 112). In the subject embodiment, during one half of the rotation of the rotor 28 about the rotation axis 29, the reciprocating members 44 are in contact with the inner surface 86 of the first ring 70*a*. During the other half of the rotation of the rotor 28 about the rotation axis 29, the reciprocating members 44 are in contact with the inner surface 86 of the second ring 70*b*.

Figure 14:
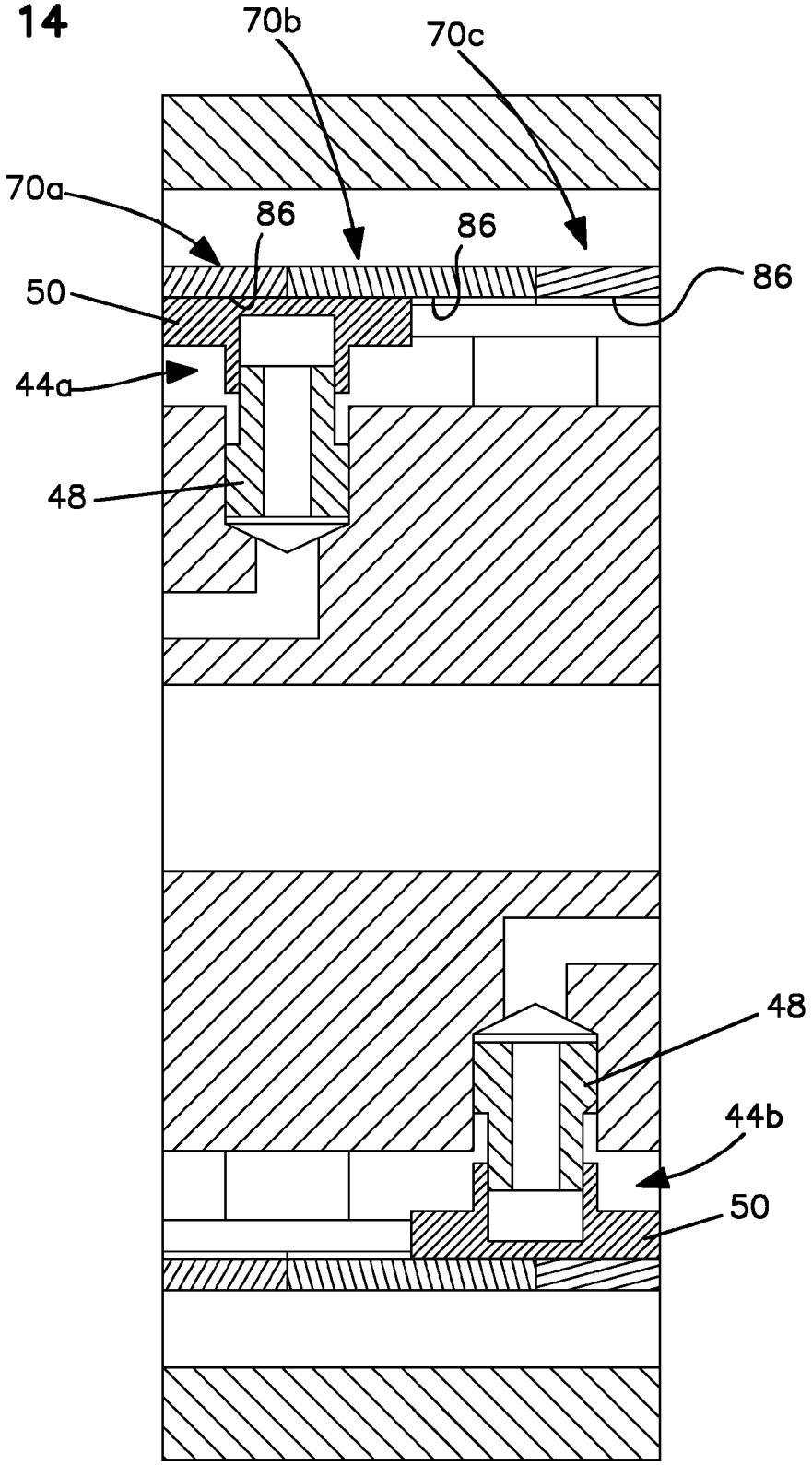
FIG. 14 is a schematic representation of an alternate embodiment of a variable displacement assembly having two sets of pumping components, wherein the variable displacement assembly is shown in the neutral position.
Figure 15:
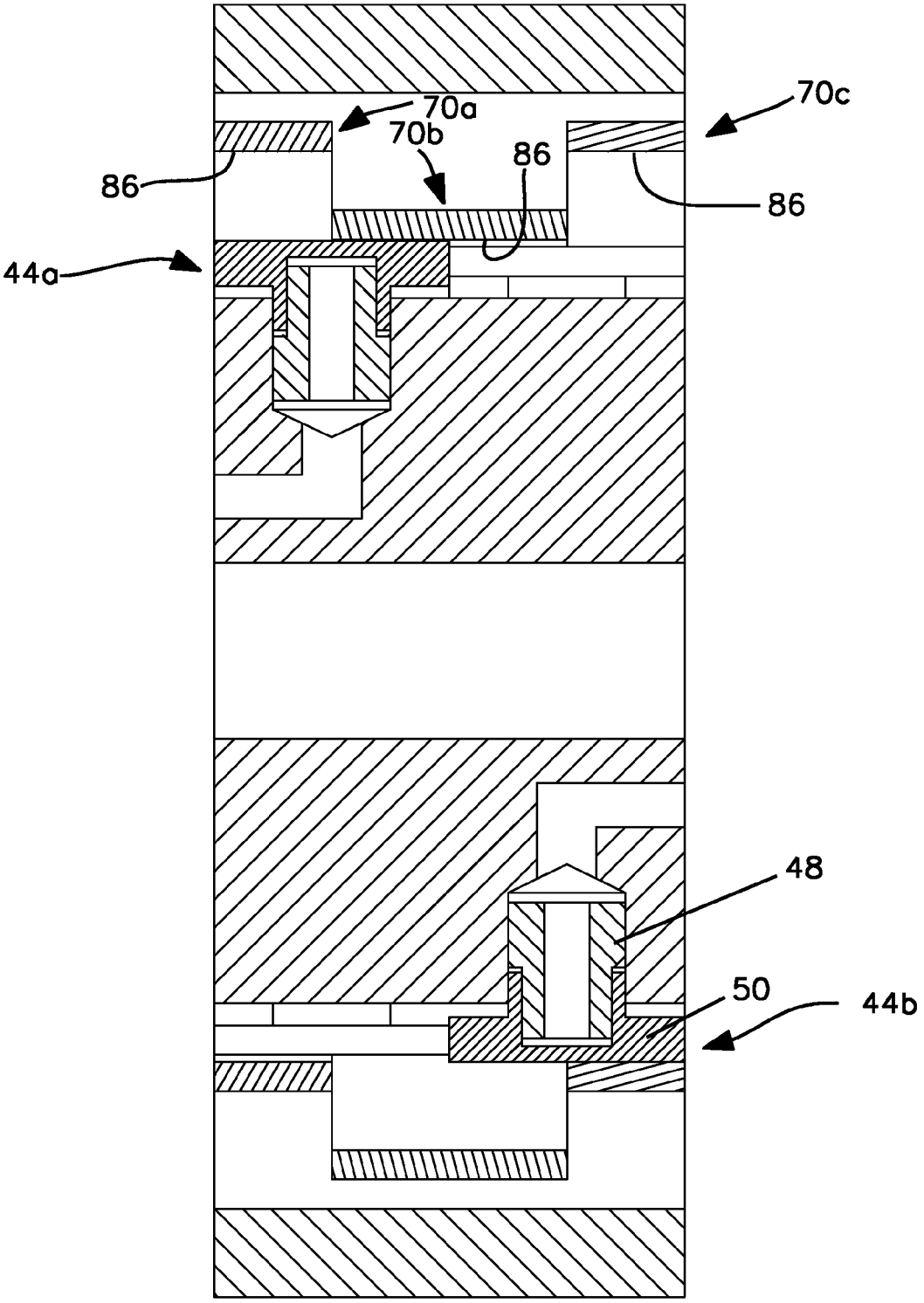
FIG. 15 is a schematic representation of the variable displacement assembly of FIG. 14 in the displaced position.
Figure 16:
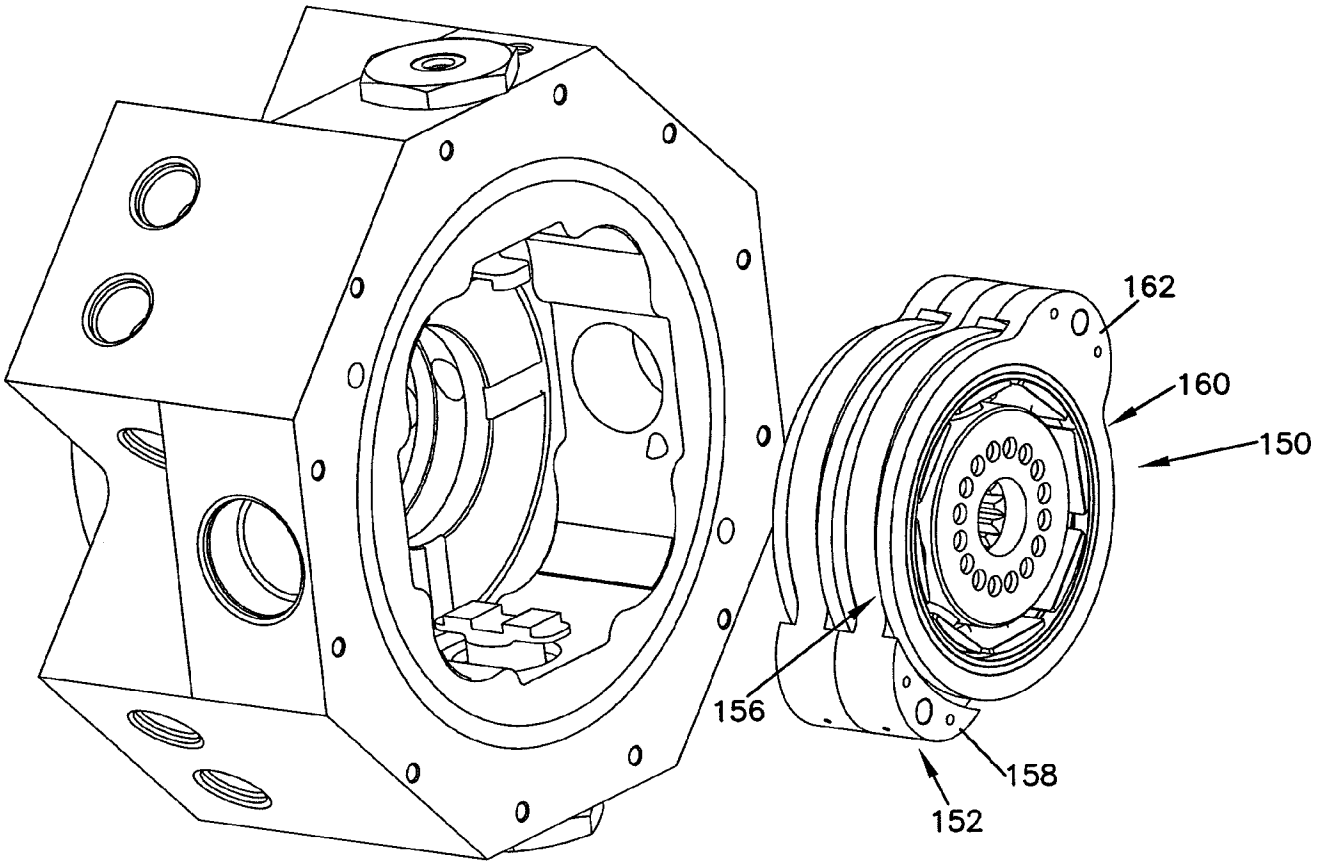
FIG. 16 is a perspective view of an alternate embodiment of a ring assembly suitable for use with the fluid device of FIG. 1.

Referring now to FIGS. 14 and 15, schematic representations of the variable displacement assembly 18 having two sets of pumping components are shown in the neutral position (shown in FIG. 14) and the displaced position (shown in FIG. 15). In this embodiment, the first plurality of reciprocating members 44*a* is adapted for engagement with at least a portion of the inner surface 86 of the first ring 70*a* and at least a portion of the inner surface 86 of the second ring 70*b* while the second plurality of reciprocating members 44*b* is adapted for engagement with at least a portion of the inner surface 86 of the second ring 70*b* and at least a portion of the inner surface 86 of the third ring 70*c*.

Referring now to FIGS. 16-19, an alternate embodiment of a ring assembly 150 suitable for use with the fluid device 10 is shown. In the depicted embodiment of FIGS. 16-19, the ring assembly 150 is adapted for use in a variable displacement assembly 18 having two sets of pumping components. It will be understood, however, that the features of the ring assembly 150 could be modified for use with a variable displacement assembly 18 having a single set of pumping components.

In the subject embodiment, the ring assembly 150 includes a first ring 152 and a second ring 154. The first ring 152 includes a first ring portion 156 and a first pivot portion 158 while the second ring 154 includes a second ring portion 160 and a second pivot portion 162.

The first ring 152 is similar to the first ring 70*a* described above. However, in the subject embodiment, the first ring portion 156 of the first ring 152 includes at least one displacement ring 164. In the subject embodiment, the first ring portion 156 of the first ring 152 includes multiple displacement rings 164. In the subject embodiment, each of the multiple displacement rings 164 of the first ring 152 is coaxial with an adjacent displacement ring 164 of the first ring 152 but axially offset from the adjacent displacement ring 164. This axial offset provides a lateral space 166 between the adjacent displacement rings 164 of the first ring 152.

In the subject embodiment, the number of displacement rings 164 in the first ring portion 156 of the first ring 152 is equal to a number (N) of sets of pumping components in the fluid device 10. In the depicted embodiment of FIGS. 16-18, and by way of example only, there are two sets of reciprocating members 44 disposed in the rotor 28, the first plurality of reciprocating members 44*a* and the second plurality of reciprocating members 44*b* (N=2). As there are two sets of reciprocating members 44 (N=2), the first ring 152 includes two displacement rings 164, a first displacement ring 164*a* and a second displacement ring 164*b*.

The second ring 154 is similar to the second ring 70*b* described above. However, in the subject embodiment, the second ring portion 160 of the second ring 154 includes at least two displacement rings 168. In the subject embodiment, each of the displacement rings 168 of the second ring 154 is coaxial with an adjacent displacement ring 168 of the second ring 154 but axially offset from the adjacent displacement ring 168. This axial offset provides a lateral space 170 between the adjacent displacement rings 168 of the second ring 154.

In the subject embodiment, the number of displacement rings 168 in the second ring portion 160 of the second ring 154 is equal to number (N) of displacement rings 164 of the first ring 152 plus one. As described above, in the depicted embodiment of FIGS. 16-18, and by way of example only, the first ring 152 includes two displacement rings 164. Therefore, in the depicted embodiment, and by way of example only, the second ring 154 includes three displacement rings 168, a first displacement ring 168*a*, a second displacement ring 168*b* and a third displacement ring 168*c*.

In the subject embodiment, a width $W_{1a}$ of the first displacement ring 164*a* of the first ring 152 is about equal to a width $W_{1b}$ of the second displacement ring 164*b* of the first ring 152. In the subject embodiment, a width $W_{2a}$ of the first displacement ring 168*a* of the second ring 154 is about equal to a width $W_{2c}$ of the third displacement ring 168*c* of the second ring 154. Each of the widths $W_{2a}$, $W_{2c}$ of the first and third displacement rings 168*a*, 168*c* is about half of the widths $W_{1a}$, $W_{1b}$ of the first and second displacement rings 164*a*, 164*b* of the first ring 152. The width $W_{2b}$ of the second displacement ring 168*b* is about equal to the width $W_{1a}$ of the first displacement ring 164*a* of the first ring 152.

Figure 19:
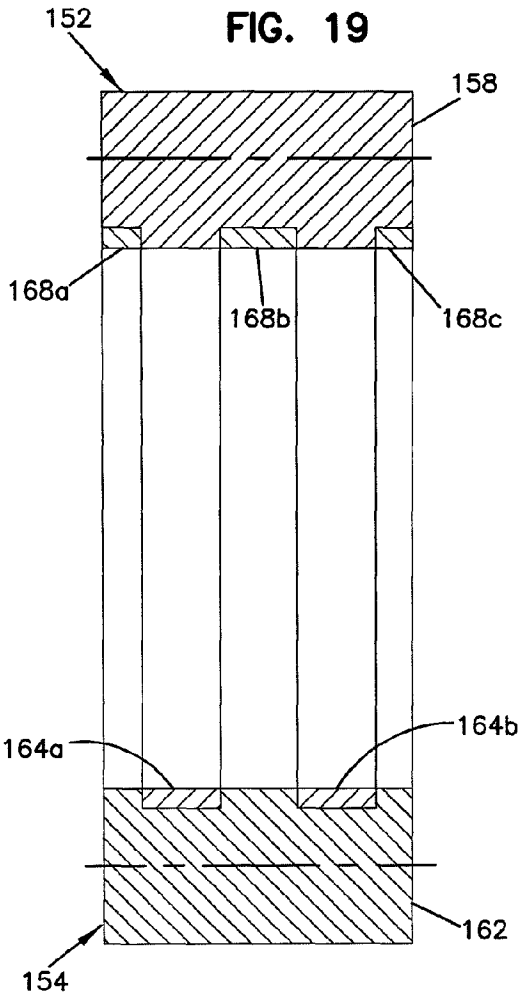
FIG. 19 is a cross-sectional view of the first and second rings of the ring assembly of FIG. 16.
Figure 18:
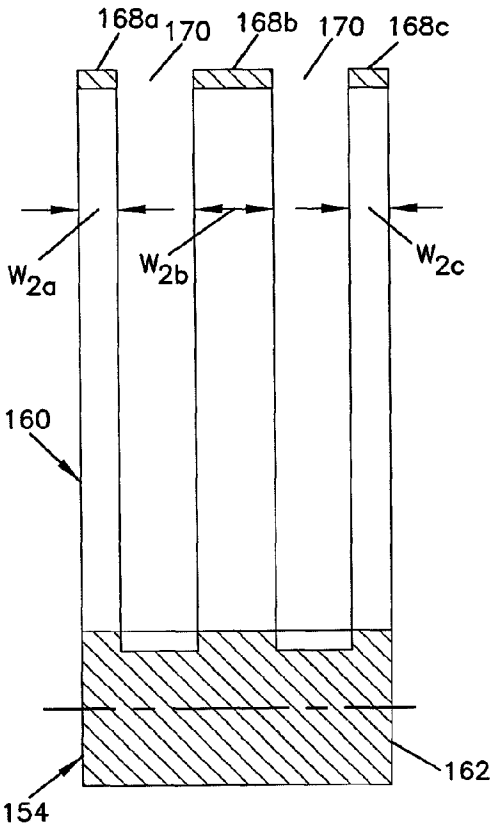
FIG. 18 is a cross-sectional view of a second ring of the ring assembly of FIG. 16.
Figure 17:
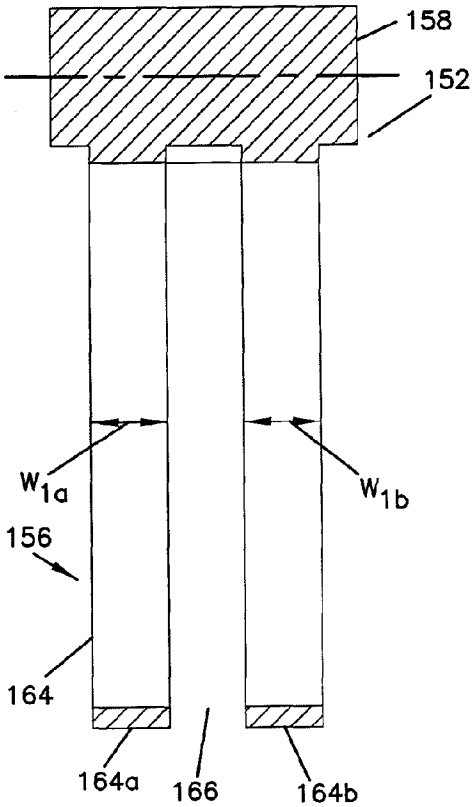
FIG. 17 is a cross-sectional view of a first ring of the ring assembly of FIG. 16.

Referring now to FIGS. 17-19, in the subject embodiment, the lateral space 170 disposed between the first and second displacement rings 168*a*, 168*b* of the second ring 154 and the lateral space 170 disposed between the second and third displacement rings 168*b*, 168*c* are adapted to receive the first and second displacement rings 164*a*, 164*b*, respectively. The lateral space 166 disposed between the first and second displacement rings 164*a*, 164*b* of the first ring 152 is adapted to receive the second displacement ring 168*b* of the second ring 154.

Figure 21:
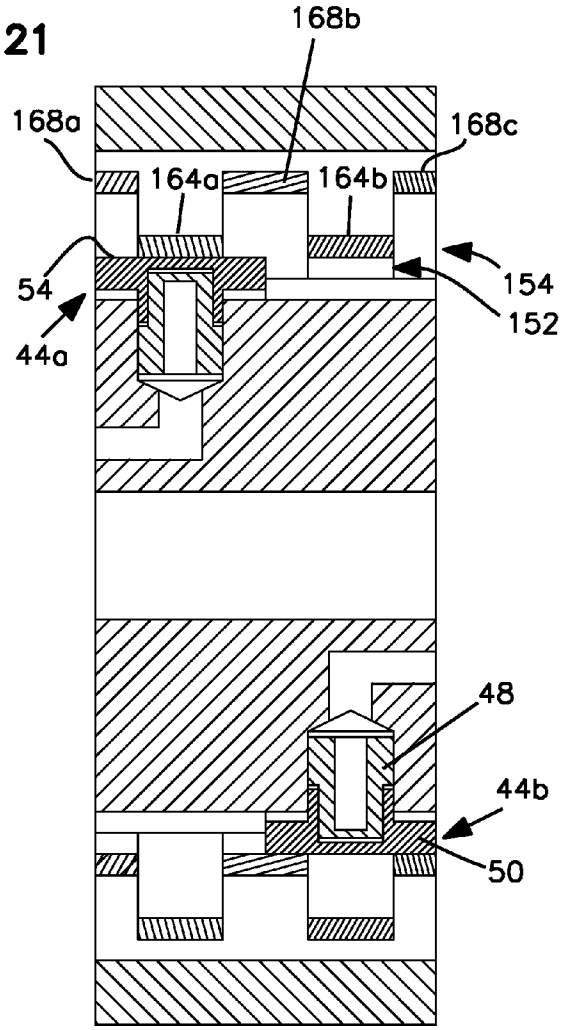
FIG. 21 is a cross-sectional view of the variable displacement assembly having the ring assembly of FIG. 16 in the displaced position.
Figure 20:
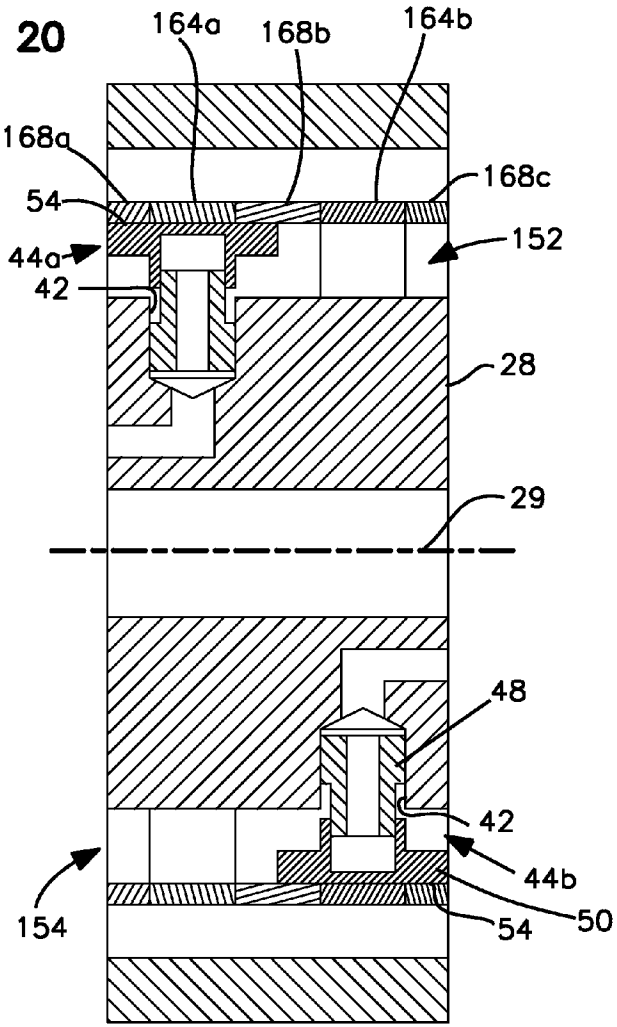
FIG. 20 is a cross-sectional view of the variable displacement assembly having the ring assembly of FIG. 16 in the neutral position.

Referring now to FIGS. 20 and 21, the first and second rings 152, 154 are shown in the neutral position (FIG. 20) and the displaced position (FIG. 21). In the neutral and displaced positions, the first displacement ring 168*a* and a first portion of the second displacement ring 168*b* of the second ring 154 and the first displacement ring 164*a* of the first ring 152 are adapted for engagement with the first plurality of reciprocating members 44*a*. The first and second displacement rings 168*a*, 168*b* of the second ring 154 are adapted for engagement with lateral edge portions of the second axial ends 54 of the first plurality of reciprocating members 44*a* while the first displacement ring 164*a* of the first ring 152 is adapted for engagement with a central portion of the second axial ends 54 of the first plurality of reciprocating members 44*a*. Similarly, the second and third displacement rings 168*b*, 168*c* of the second ring 154 are adapted for engagement with lateral edge portions of the second axial ends 54 of the second plurality of reciprocating members 44*b* while the second displacement ring 164*b* of the first ring 152 is adapted for engagement with a central portion of the second axial ends 54 of the second plurality of reciprocating members 44*b*. This arrangement of displacement rings is potentially advantageous as it provides balanced loading on the reciprocating members 44 as the rotor 28 rotates about the rotation axis 29. At high pressures, balanced loading on the reciprocating members 44 prevents or reduces the risk of the reciprocating members 44 tipping in the bores 42.

Figure 22:
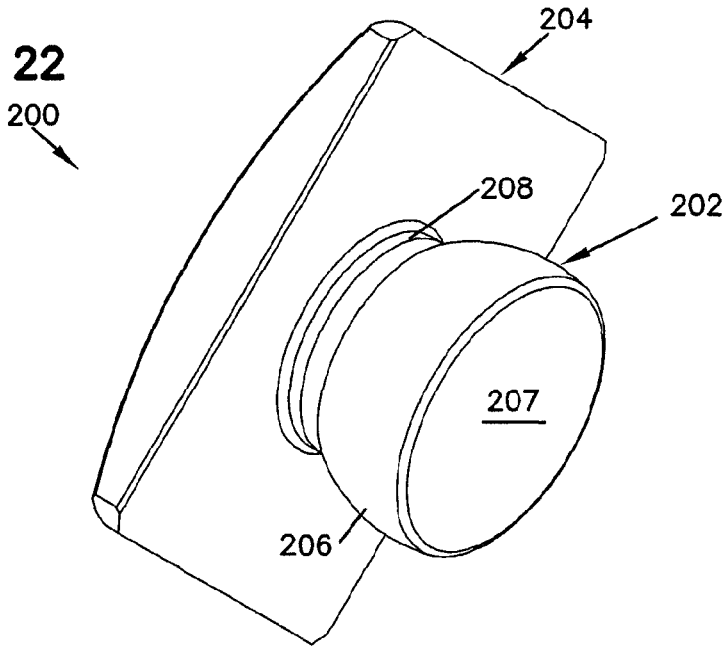
FIG. 22 is a perspective view of an alternate embodiment of a reciprocating member suitable for use with the fluid device of FIG. 1.
Figure 23:
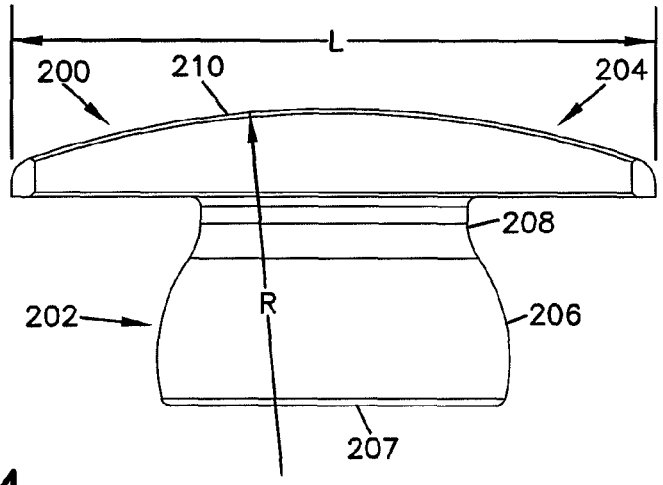
FIG. 23 is a front view of the reciprocating member of FIG. 22.
Figure 24:
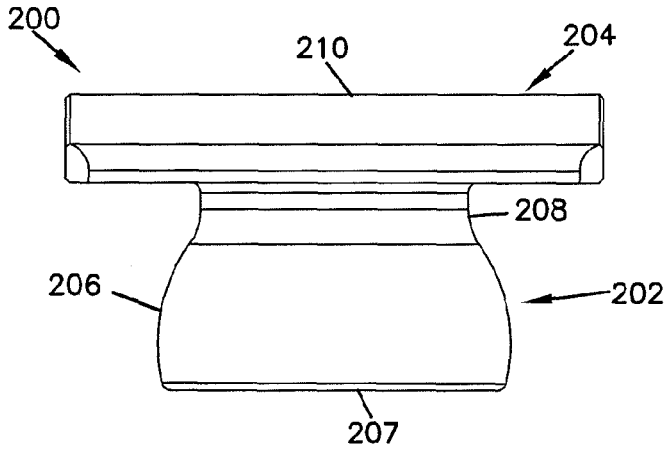
FIG. 24 is a side view of the reciprocating member of FIG. 22.

Referring now to FIGS. 22-24, an alternate embodiment of a reciprocating member 200 suitable for use with the fluid device 10 is shown. The reciprocating member 200 includes a first axial end portion 202, which is adapted for engagement in the bore 42 of the rotor 28, and an opposite second axial end portion 204, which is adapted for engagement with the cam surface 55 of the variable displacement assembly 18.

In the subject embodiment, the first axial end portion 202 of the reciprocating member 200 is adapted to reciprocate in the bore 42. In the subject embodiment, the bore 42 of the rotor 28 and the first axial end portion 202 of the reciprocating member 200 define the volume chamber 56 that expands and contracts as the reciprocating member 200 extends and retracts in the bore 42.

The first axial end portion 202 includes a frusto-spherical portion 206. The frusto-spherical portion 206 includes a maximum diameter that is sized slightly smaller than the diameter of the bore 42 to allow the reciprocating member 200 to reciprocate within the bore 42 while reducing fluid leakage from the volume chambers 56 between the bore 42 and the frusto-spherical portion 206.

The first axial end portion 202 further includes an end surface 207. In the subject embodiment, the end surface 207 is immediately adjacent to the frusto-spherical surface 206. In the depicted embodiment, the end surface 207 is flat surface.

The first axial end portion 202 further includes a neck portion 208. In the subject embodiment, the neck portion 208 joins the frusto-spherical portion 206 of the first axial end portion 202 to the second axial end portion 204 of the reciprocating member 200. The neck portion 208 is sized such that the outer diameter of the neck portion 208 is smaller than the diameter of the frusto-spherical portion 206.

In the subject embodiment, the second axial end portion 204 includes an outer surface 210. The outer surface 210 of the second axial end portion 204 is adapted for engagement with the cam surface 55 of the variable displacement assembly 18. In the depicted embodiment, the outer surface 210 of the second axial end portion 204 defines a length L and a width W. The outer surface 210 defines a radius R along the length L. The radius R is less than or equal to the radius of the inner surface 86 of the bore 84.

Figure 25:
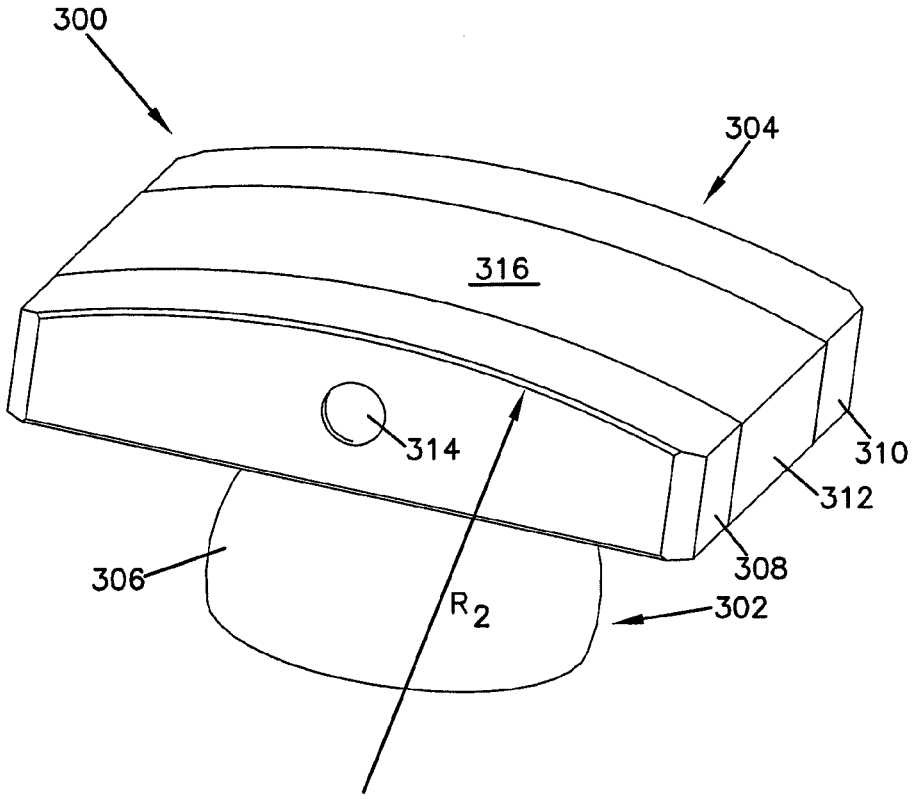
FIG. 25 is a perspective view of a multi-segment reciprocating member suitable for use with the fluid device of FIG. 1.

Referring now to FIG. 25, an alternate embodiment of a reciprocating member 300 is shown. The alternate embodiment of the reciprocating member 300 includes a first axial end portion 302 and a second axial end portion 304.

In the subject embodiment, the first axial end portion 302 of the reciprocating member 300 is adapted to reciprocate in the bore 42. The first axial end portion 302 includes a frusto-spherical portion 306. The frusto-spherical portion 306 includes a maximum diameter that is sized slightly smaller than the diameter of the bore 42 to allow the reciprocating member 300 to reciprocate within the bore 42 while reducing fluid leakage from the volume chambers 56 between the bore 42 and the frusto-spherical portion 306.

The second axial end portion 304 includes a first lateral edge segment 308, an oppositely disposed second lateral edge segment 310 and a center segment 312, with the center segment 312 disposed between the first and second lateral edge segments 308, 310. In the subject embodiment, the first and second lateral edge segments 308, 310 are adapted for engagement with the first and second displacement rings 168*a*, 168*b* of the second ring 154 while the center segment 312 is adapted for engagement with the first displacement ring 164*a* of the first ring 152.

The first and second lateral edge segments 308, 310 of the second axial end portion 304 are adapted movement relative to the central segment 312. In the subject embodiment, the first and second lateral edge segments 308, 310 pivot about a pin 314 that pivotally engages the first and second lateral edge segments 308, 310 to the center segment 312. In the subject embodiment, the first and second lateral edge segments 308, 310 pivot independently about the pin 314.

In the subject embodiment, each of the first and second lateral edge segments 308, 310 and the center segment 312 include an outer surface 316. The outer surface 316 of each of the first and second lateral edge segments 308, 310 and the center segment 312 of the second axial end portion 304 is adapted for engagement with at least a portion of the cam surface 55 of the variable displacement assembly 18. In the depicted embodiment, the outer surface 316 defines a radius $R_2$.

In the subject embodiment, the reciprocating member 300 includes a neck portion that engages the center segment 312 of the second axial end portion 304 to the first axial end portion 302. In the subject embodiment, the neck portion joins the frusto-spherical portion 306 of the first axial end portion 302 to the center segment 312 of the second axial end portion 304 of the reciprocating member 300. In the subject embodiment, the neck portion is rigidly engaged with the central segment 312 of the second axial end portion 304. In the subject embodiment, the neck portion is integral with center segment 312 of the second axial end portion 304.

This multi-segment reciprocating member 300 is potentially advantageous as it allows for a smooth transition in a transition area that is located at the intersection of the first circumferential portion 110 to the second circumferential portion 112 of the cam surface 55 when the ring assembly 22 is in the displaced position. In operation, the first and second lateral edge segments 308, 310 pivot about the pin 314 so as to gradually disengage from the first and second displacement rings 168*a*, 168*b* of the second ring 154 as the center segment 312 engages the first displacement ring 164*a* of the first ring 152 when the ring assembly 22 is in the displaced position. This pivoting of the first and second lateral edge segments 308, 310 affects the loading on the second axial end 304 of the reciprocating members 300 by preventing an abrupt change in contact area between the reciprocating members 300 and the cam surface 55 in the transition area.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A variable displacement assembly for a fluid device, the variable displacement assembly comprising:

a rotor;

a plurality of reciprocating members in engagement with the rotor, each of the reciprocating members having an axial end having a first portion and a second portion;

a ring assembly defining a cam surface in engagement with the reciprocating members, the ring assembly having a first ring and an axially adjacent second ring, at least one of the first and second rings being adapted for selective movement relative to the other between a neutral position and a displaced position, the first ring having a first ring portion defining a bore having an inner surface, the second ring having a second ring portion defining a bore having an inner surface, wherein the first portion of the axial end of each reciprocating member acts against the inner surface of the first ring portion and the second portion of the axial end of the reciprocating member acts against the inner surface of the second ring portion, wherein the cam surface is defined by an intersection of the first ring portion and the second ring portion, and wherein a first circumferential portion of the inner surface of the first ring portion and a second circumferential portion of the inner surface of the second ring portion define the cam surface in the displaced position.

2. A variable displacement assembly for a fluid device as claimed in claim 1, wherein the first ring includes a first band disposed in the bore of the first ring portion, and an inner surface of the first band defines the inner surface of the first ring portion, and wherein the second ring includes a second band disposed in the bore of the second ring portion, and an inner surface of the second band defines the inner surface of the second ring portion.

3. A variable displacement assembly for a fluid device as claimed in claim 1, wherein each reciprocating member includes a piston member and a piston shoe, the piston member having a first axial end portion and a second axial end portion, the piston shoe being in reciprocating engagement with the second axial end portion of the piston member.

4. A variable displacement assembly for a fluid device as claimed in claim 3, wherein the first axial end portion of the piston member is disposed in stationary engagement with a bore disposed about the rotor.

5. A variable displacement assembly for a fluid device as claimed in claim 1, wherein the first ring includes a pivot portion about which the first ring selectively pivots.

6. A variable displacement assembly for a fluid device as claimed in claim 5, wherein the pivot portion extends outwardly from an outer surface of first ring portion.

7. A variable displacement assembly for a fluid device as claimed in claim 1, wherein the first ring portion includes at least one displacement ring.

8. A variable displacement assembly for a fluid device as claimed in claim 7, wherein the second ring portion includes at least two displacement rings.

9. A variable displacement assembly for a fluid device as claimed in claim 8, wherein the displacement ring of the first ring portion is disposed between the two displacement rings of the second ring portion.

10. A variable displacement assembly for a fluid device as claimed in claim 8, wherein the at least one displacement ring of the first ring portion and the two displacement rings of the second ring portion are alternatingly disposed in the ring assembly.

11. A variable displacement assembly for a fluid device as claimed in claim 8, wherein the second ring portion defines a lateral space between the at least one displacement ring of the first ring portion and the at least two displacement rings of the second ring portion adjacent the at least one displacement ring of the first ring portion.

12. A variable displacement assembly for a fluid device as claimed in claim 11, wherein the displacement ring of the first ring portion is disposed in the lateral space of the second ring portion.

13. A fluid device, comprising:

a housing defining a fluid inlet and a fluid outlet;

a displacement assembly in fluid communication with the fluid inlet and the fluid outlet, the displacement assembly including:

a rotor having a rotation axis about which the rotor selectively rotates and defining a plurality of bores;

a plurality of reciprocating members in engagement with the plurality of bores of the rotor, each of the reciprocating members having an axial end having a first portion and a second portion;

a ring assembly defining a cam surface in engagement with the reciprocating members, the ring assembly having a first ring and an axially adjacent second ring, the first ring having a first ring portion defining a first central axis and a bore having an inner surface, the second ring having a second ring portion defining a second central axis and a bore having an inner surface, wherein the first portion of the axial end of each reciprocating member acts against the inner surface of the first ring portion and the second portion of the axial end of the reciprocating member acts against the inner surface of the second ring portion, and wherein the first central axis of the first ring portion is offset from the second central axis of the second ring portions and the rotation axis of the rotor so that the cam surface is defined by an intersection of the first ring portion and the second ring portion.

14. A fluid device as claimed in claim 13, wherein the fluid device is of a radial piston type.

15. A fluid device as claimed in claim 13, wherein the displacement assembly is variable.

16. A fluid device as claimed in claim 15, wherein the first ring moves relative to the second ring between a neutral position and a displaced position.

17. A fluid device as claimed in claim 16, wherein the first ring includes a pivot portion about which the first ring selectively pivots.

18. A fluid device as claimed in claim 17, wherein the pivot portion extends outwardly from an outer surface of first ring portion.

19. A fluid device as claimed in claim 13, wherein the first ring portion includes at least one displacement ring.

20. A fluid device as claimed in claim 19, wherein the second ring portion includes at least two displacement rings.

21. A fluid device as claimed in claim 13, wherein each of the reciprocating members includes a first axial end portion and a second axial end portion.

22. A fluid device as claimed in claim 21, wherein the second axial end portion of each of the reciprocating members is adapted for engagement with the cam surface.

23. A fluid device as claimed in claim 21, wherein the first axial end portion includes a frusto-spherical portion adapted for reciprocating within one of the bores of the rotor.

24. A fluid device as claimed in claim 21, wherein the second axial end portion includes a plurality of pivotally engaged segments.

25. A variable displacement assembly for use in a rotary fluid device, the variable displacement assembly comprising:

a rotor having a rotation axis and defining a plurality of bores;

a plurality of reciprocating members in engagement with the plurality of bores of the rotor, each of the reciprocating members having an axial end having a first portion and a second portion;

a ring assembly defining a cam surface in engagement with the reciprocating members, the ring assembly having a first ring and an axially adjacent second ring, at least one of the first and second rings being adapted for selective movement relative to the other between a neutral position and a displaced position, the first ring having a first ring portion having at least one displacement ring, the at least one displacement ring defining a central axis and a bore having an inner surface, the second ring having a second ring portion having at least two displacement rings, the at least two displacement rings defining a central axis and a bore having an inner surface, wherein the first portion of the axial end of each reciprocating member acts against one of the inner surface of the at least one displacement ring of the first ring portion and the inner surface of the at least two displacement rings of the second ring portion, wherein the second portion of the axial end of each reciprocating member acts against the other of the inner surface of the at least one displacement ring of the first ring portion and the inner surface of the at least two displacement rings of the second ring portion, and wherein at least one of the central axes of the first and second ring portions is offset from the rotation axis of the rotor in the displaced position so that the cam surface is defined by an intersection of the first ring portion and the second ring portion.

26. A variable displacement assembly for a fluid device, the variable displacement assembly comprising:

a rotor defining a plurality of radial bores, the rotor being rotatable about a central axis of rotation;

a plurality of ring engaging components positioned at each of the bores, the ring engaging components being mounted to radially reciprocate relative to the rotor, the ring engaging components each including a first ring engaging portion and a second ring engaging portion;

a ring assembly defining a cam surface in engagement with the ring engaging components, the ring assembly having a first ring and a second ring positioned axially adjacent one anther along the axis of rotation of the rotor, the first and second rings extending around the axis of rotation of the rotor, at least one of the first and second rings being adapted for selective movement relative to the other between a neutral position and a displaced position, the first ring having a first ring portion defining a bore having an inner surface, the second ring having a second ring portion defining a bore having an inner surface, wherein the first ring engaging portion of each ring engaging component acts against the inner surface of the first ring portion and the second ring engaging portion of each ring engaging component acts against the inner surface of the second ring portion, wherein the first and second ring portions each define first and second circumferential portions, wherein the first ring engaging portions of the ring engaging components engage the first circumferential portion of the first ring portion and do not engage the second circumferential portion of the first ring portion when the ring assembly is in the displaced position, wherein the second ring engaging portions of the ring engaging components engage the second circumferential portion of the second ring portion and do not engage the first circumferential portion of the second ring portion when the ring assembly is in the displaced position, and wherein in the displaced positon the first circumferential portion of the first ring portion and the second circumferential portion of the second ring portion cooperate to define the cam surface.

27. The variable displacement assembly of claim 26, wherein the first ring engaging portions of the ring engaging components engage the first and second circumferential portions of the first ring portion when the ring assembly is in the neutral position, and wherein the second ring engaging portions of the ring engaging components engage the first and second circumferential portions of the second ring portion when the ring assembly is in the neutral position.

28. The variable displacement assembly of claim 26, wherein both the first and second rings are movable to move the ring assembly between the neutral and displaced positions.

29. The variable displacement assembly of claim 26, further comprising a first actuator for moving the first ring and a second actuator for moving the second ring when the ring assembly is moved between the neutral and displaced positions.

* * * * *